US011828039B2

(12) United States Patent
Tsukamoto et al.

(10) Patent No.: US 11,828,039 B2
(45) Date of Patent: Nov. 28, 2023

(54) SHOVEL

(71) Applicant: SUMITOMO CONSTRUCTION MACHINERY CO., LTD., Tokyo (JP)

(72) Inventors: Hiroyuki Tsukamoto, Chiba (JP); Takashi Nishi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 311 days.

(21) Appl. No.: 16/911,802

(22) Filed: Jun. 25, 2020

(65) Prior Publication Data

US 2020/0325650 A1 Oct. 15, 2020

Related U.S. Application Data

(63) Continuation of application No. PCT/JP2018/048388, filed on Dec. 27, 2018.

(30) Foreign Application Priority Data

Dec. 27, 2017 (JP) ..... 2017-252608

(51) Int. Cl.
*E02F 3/43* (2006.01)
*E02F 9/20* (2006.01)
(Continued)

(52) U.S. Cl.
CPC ..... *E02F 3/439* (2013.01); *E02F 9/2041* (2013.01); *E02F 9/2228* (2013.01); *E02F 9/2278* (2013.01); *E02F 9/262* (2013.01)

(58) Field of Classification Search
CPC ..... E02F 3/439; E02F 9/2041; E02F 9/2228; E02F 9/2278; E02F 9/262; E02F 9/205;
(Continued)

(56) References Cited

U.S. PATENT DOCUMENTS 5,826,666 A 10/1998 Tozawa et al.
5,975,214 A 11/1999 Okamura et al.
(Continued)

FOREIGN PATENT DOCUMENTS

DE 112015006349 12/2017
EP 3650604 5/2020
(Continued)

OTHER PUBLICATIONS

Machine translation of JP-09228404-A retrieved from Espacenet on Jun. 14, 2022 (Year: 2022).*
(Continued)

*Primary Examiner* — Thomas Ingram
*Assistant Examiner* — Faris Asim Shaikh
(74) *Attorney, Agent, or Firm* — IPUSA, PLLC

(57) ABSTRACT

A shovel includes a lower traveling body, an upper turning body turnably mounted on the lower traveling body, a cab mounted on the upper turning body, an attachment attached to the upper turning body, a hardware processor, and a display device. The hardware processor is configured to move the end attachment of the attachment relative to an intended work surface with the ground being pressed with a predetermined force by the working part of the end attachment, in response to a predetermined operation input related to the attachment. The display device is configured to display information on an irregularity of the ground.

17 Claims, 15 Drawing Sheets

(51) Int. Cl.
*E02F 9/22* (2006.01)
*E02F 9/26* (2006.01)

(58) Field of Classification Search
CPC . E02F 3/437; E02F 9/20; E02F 9/2235; E02F 9/2242; E02F 9/2282; E02F 9/2285; E02F 9/2292; E02F 9/2296; E02F 9/26; E02F 9/265; E02F 3/435; E02F 9/2025
See application file for complete search history.

(56) References Cited

U.S. PATENT DOCUMENTS

| | | | | |
|---|---|---|---|---|
| 7,490,421 | B1 | 2/2009 | Pletzer et al. | |
| 2005/0004734 | A1* | 1/2005 | Cripps | E02F 3/435 701/50 |
| 2010/0245542 | A1* | 9/2010 | Kim | G01B 11/00 37/444 |
| 2011/0106384 | A1 | 5/2011 | Corke et al. | |
| 2013/0087350 | A1* | 4/2013 | Hayashi | E02F 3/844 701/50 |
| 2014/0032030 | A1* | 1/2014 | Stratton | E02F 9/2025 701/33.9 |
| 2014/0099178 | A1* | 4/2014 | Nomura | E02F 9/26 414/685 |
| 2018/0080199 | A1* | 3/2018 | Deguchi | G01C 15/002 |
| 2018/0313062 | A1 | 11/2018 | Tsukamoto | |

FOREIGN PATENT DOCUMENTS

| | | | | |
|---|---|---|---|---|
| EP | 3708718 | | 9/2020 | |
| JP | H08-013459 | | 1/1996 | |
| JP | 09228404 | A * | 9/1997 | E02F 3/437 |
| JP | H09-228404 | | 9/1997 | |
| JP | H10-219727 | | 8/1998 | |
| JP | 2003-105795 | | 4/2003 | |
| JP | 2003105795 | A * | 4/2003 | E02F 3/43 |
| JP | 2011-043002 | | 3/2011 | |
| JP | 2013-161192 | | 8/2013 | |
| JP | 2013-217137 | | 10/2013 | |
| JP | 2015-190114 | | 11/2015 | |
| JP | 2015190114 | A * | 11/2015 | G06Q 50/08 |
| JP | 2017-122602 | | 7/2017 | |
| KR | 100240091 | B1 * | 1/2000 | E02F 3/422 |
| KR | 20150122895 | A * | 11/2015 | E02F 3/43 |
| WO | WO-2005103396 | A1 * | 11/2005 | E02F 3/435 |
| WO | 2017/115810 | | 7/2017 | |

OTHER PUBLICATIONS

Machine translation of KR-100240091-B1 retrieved from Google Patents on Jun. 17, 2023 (Year: 2023).*
Machine translation of JP-2015190114-A retrieved from Espacenet on Jun. 13, 2022 (Year: 2022).*
Machine translation of JP-2003105795-A retrieved from JPlatPat on Jun. 13, 2022 (Year: 2022).*
Machine translation of KR 20150122895 A retrieved from Espacenet on Jun. 28, 2023 (Year: 2023).*
Machine translation of WO-2005103396-A1 retrieved from Espacenet on Jun. 28, 2023 (Year: 2023).*
International Search Report for PCT/JP2018/048388 dated Mar. 26, 2019.
International Search Report for PCT/JP2018/048387 dated Mar. 26, 2019.
Office Action dated Jun. 22, 2022 issued to related U.S. Appl. No. 16/911,788.
Machine translation of JPH0813459A retrieved from Espacenet on Jun. 15, 2022(Year: 2022).
Office Action dated Dec. 6, 2022 issued to related U.S. Appl. No. 16/911,788.

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/048388, filed on Dec. 27, 2018 and designating the U.S., which claims priority to Japanese patent application No. 2017-252608, filed on Dec. 27, 2017. The entire contents of the foregoing applications are incorporated herein by reference.

BACKGROUND

Technical Field

The present disclosure relates to shovels.

Description of Related Art

A work machine control system that automatically adjusts the position of the teeth tips of a bucket during the work of forming a slope by moving the teeth tips of the bucket along a designed surface from the lower end to the upper end of the slope has been known. According to this system, it is possible to match the formed slope with the designed surface by automatically adjusting the position of the teeth tips of the bucket.

SUMMARY

According to an embodiment of the present invention, a shovel includes a lower traveling body, an upper turning body turnably mounted on the lower traveling body, a cab mounted on the upper turning body, an attachment attached to the upper turning body, a hardware processor, and a display device. The hardware processor is configured to move the end attachment of the attachment relative to an intended work surface with the ground being pressed with a predetermined force by the working part of the end attachment, in response to a predetermined operation input related to the attachment. The display device is configured to display information on an irregularity of the ground.

DETAILED DESCRIPTION

According to the related-art system, the teeth tips of the bucket are only automatically adjusted in position to be along the designed surface. Therefore, the slope formed as a finished surface may be partly soft and partly hard. That is, a finished surface having uneven hardness may be formed.

Therefore, it is desired to provide a shovel that assists in forming a more uniform finished surface.

According to an aspect of the present invention, a shovel that assists in forming a more uniform finished surface is provided.

Figure 1:
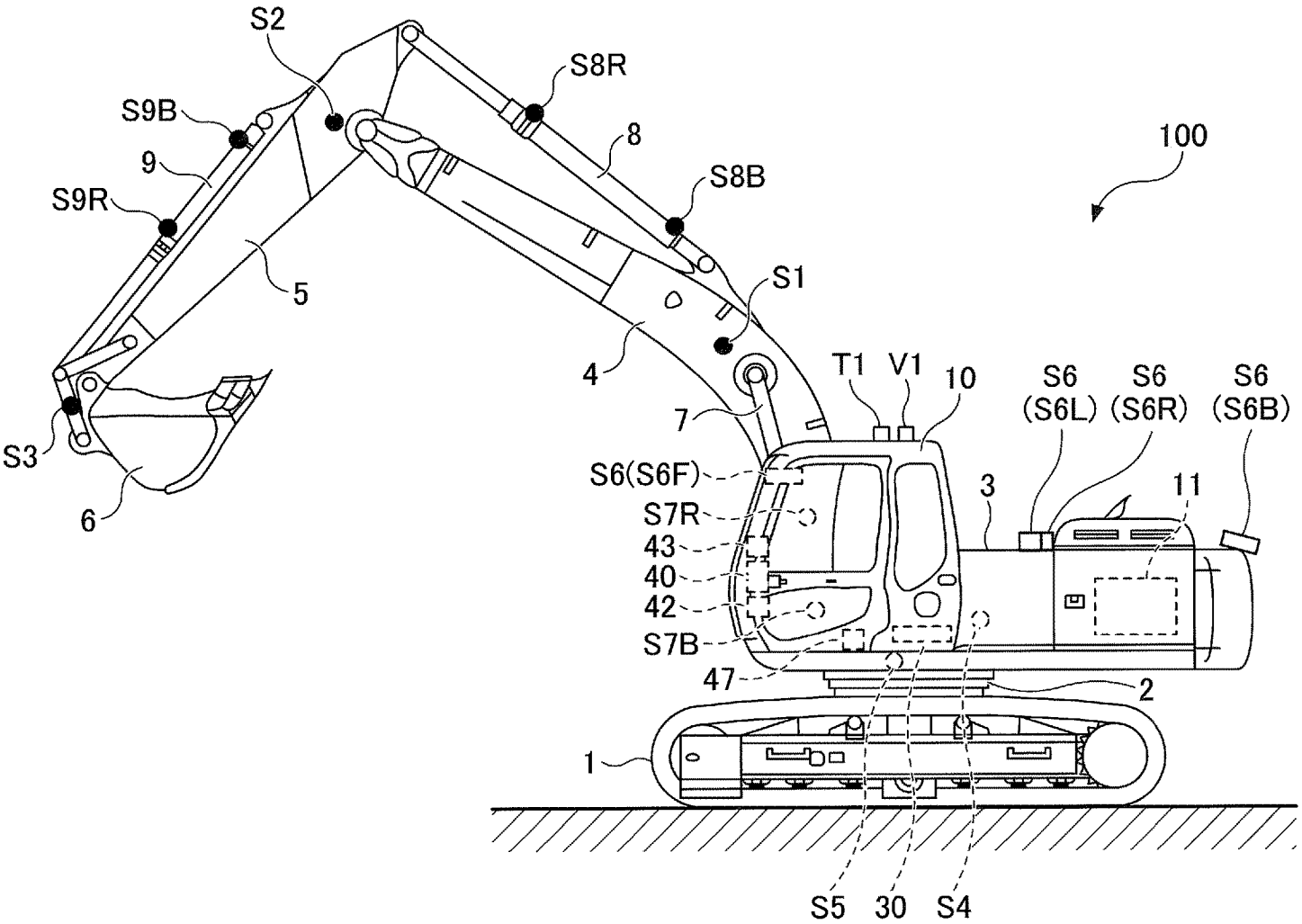
FIG. 1 is a side view of a shovel according to an embodiment of the present invention.

FIG. 1 is a side view of a shovel 100 serving as an excavator according to an embodiment of the present invention. An upper turning body 3 is turnably mounted on a lower traveling body 1 via a turning mechanism 2. A boom 4 is attached to the upper turning body 3. An arm 5 is attached to the distal end of the boom 4, and a bucket 6 serving as an end attachment is attached to the distal end of the arm 5. The bucket 6 may be a slope bucket.

The boom 4, the arm 5, and the bucket 6 constitute an excavation attachment that is an example of an attachment. The boom 4 is driven by a boom cylinder 7, the arm 5 is driven by an arm cylinder 8, and the bucket 6 is driven by a bucket cylinder 9. A boom angle sensor S1 is attached to the boom 4, an arm angle sensor S2 is attached to the arm 5, and a bucket angle sensor S3 is attached to the bucket 6.

The boom angle sensor S1 is configured to detect the rotation angle of the boom 4. According to this embodiment, the boom angle sensor S1 is an acceleration sensor and can detect the rotation angle of the boom 4 relative to the upper turning body 3 (hereinafter, "boom angle"). For example, the boom angle is smallest when the boom 4 is lowest and increases as the boom 4 is raised.

The arm angle sensor S2 is configured to detect the rotation angle of the arm 5. According to this embodiment, the arm angle sensor S2 is an acceleration sensor and can detect the rotation angle of the arm 5 relative to the boom 4 (hereinafter, "arm angle"). For example, the arm angle is smallest when the arm 5 is most closed and increases as the arm 5 is opened.

The bucket angle sensor S3 is configured to detect the rotation angle of the bucket 6. According to this embodiment, the bucket angle sensor S3 is an acceleration sensor and can detect the rotation angle of the bucket 6 relative to the arm 5 (hereinafter, "bucket angle"). For example, the bucket angle is smallest when the bucket 6 is most closed and increases as the bucket 6 is opened.

Each of the boom angle sensor S1, the arm angle sensor S2, and the bucket angle sensor S3 may alternatively be a potentiometer using a variable resistor, a stroke sensor that detects the stroke amount of a corresponding hydraulic cylinder, a rotary encoder that detects a rotation angle about a link pin, a gyroscope, an inertial measurement unit that is a combination of an acceleration sensor and a gyroscope, or the like.

According to this embodiment, a boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9.

The boom rod pressure sensor S7R detects the pressure of the rod-side oil chamber of the boom cylinder 7 (hereinafter, "boom rod pressure"), and the boom bottom pressure sensor S7B detects the pressure of the bottom-side oil chamber of the boom cylinder 7 (hereinafter, "boom bottom pressure"). The arm rod pressure sensor S8R detects the pressure of the rod-side oil chamber of the arm cylinder 8 (hereinafter, "arm rod pressure"), and the arm bottom pressure sensor S8B detects the pressure of the bottom-side oil chamber of the arm cylinder 8 (hereinafter, "arm bottom pressure"). The bucket rod pressure sensor S9R detects the pressure of the rod-side oil chamber of the bucket cylinder 9 (hereinafter, "bucket rod pressure"), and the bucket bottom pressure sensor S9B detects the pressure of the bottom-side oil chamber of the bucket cylinder 9 (hereinafter, "bucket bottom pressure").

A cabin 10 that is a cab is provided and a power source such as an engine 11 is mounted on the upper turning body 3. Furthermore, a controller 30, a display device 40, an input device 42, an audio output device 43, a storage device 47, a positioning device V1, a body tilt sensor S4, a turning angular velocity sensor S5, an image capturing device S6, a communications device T1, etc., are attached to the upper turning body 3.

The controller 30 is configured to operate as a main control part to control the driving of the shovel 100. According to this embodiment, the controller 30 is constituted of a computer including a CPU, a RAM, a ROM, etc. Various functions of the controller 30 are implemented by the CPU executing programs stored in the ROM, for example. The various functions include, for example, a machine guidance function to guide (give directions to) an operator in manually operating the shovel 100 directly or manually operating the shovel 100 remotely, a machine control function to automatically assist the operator in manually operating the shovel 100 directly or manually operating the shovel 100 remotely, and an automatic control function to implement unmanned operation of the shovel 100. A machine guidance part 50 included in the controller 30 is configured to be able to execute the machine guidance function, the machine control function, and the automatic control function.

The display device 40 is configured to display various kinds of information. The display device 40 may be connected to the controller 30 via a communications network such as a CAN or may be connected to the controller 30 via a dedicated line.

The input device 42 is so configured as to enable the operator to input various kinds of information to the controller 30. The input device 42 is, for example, at least one of a touchscreen provided in the cabin 10, a knob switch provided at the end of an operating lever or the like, push button switches provided around the display device 40, etc.

The audio output device 43 is configured to output sound or voice. Examples of the audio output device 43 may include a loudspeaker connected to the controller 30 and an alarm such as a buzzer. According to this embodiment, the audio output device 43 is configured to output various kinds of sound or voice in response to an audio output command from the controller 30.

The storage device 47 is configured to store various kinds of information. Examples of the storage device 47 may include a nonvolatile storage medium such as a semiconductor memory. The storage device 47 may store the output information of various devices while the shovel 100 is in operation and may store information obtained through various devices before the shovel 100 starts to operate. The storage device 47 may store, for example, data on an intended work surface obtained through the communications device T1, etc. The intended work surface may be set by the operator of the shovel 100 or may be set by a work manager or the like.

The positioning device V1 is configured to be able to measure the position of the upper turning body 3. The positioning device V1 may also be configured to measure the orientation of the upper turning body 3. The positioning device V1 is, for example, a GNSS compass, and detects the position and orientation of the upper turning body 3 to output detection values to the controller 30. Therefore, the positioning device V1 can operate as an orientation detector to detect the orientation of the upper turning body 3. The orientation detector may be an azimuth sensor or the like attached to the upper turning body 3.

The body tilt sensor S4 is configured to detect the inclination of the upper turning body 3. According to this embodiment, the body tilt sensor S4 is an acceleration sensor that detects the longitudinal tilt angle around the longitudinal axis and the lateral tilt angle around the lateral axis of the upper turning body 3 to a virtual horizontal plane. For example, the longitudinal axis and the lateral axis of the upper turning body 3 cross each other at right angles at the shovel center point that is a point on the turning axis of the shovel 100. The body tilt sensor S4 may be a combination of an acceleration sensor and a gyroscope or an inertial measurement unit.

The turning angular velocity sensor S5 is configured to detect the turning angular velocity of the upper turning body 3. The turning angular velocity sensor S5 may be configured to detect or calculate the turning angle of the upper turning body 3. According to this embodiment, the turning angular velocity sensor S5 is a gyroscope, but may also be a resolver, a rotary encoder, or the like.

The image capturing device S6 is configured to obtain an image of an area surrounding the shovel 100. According to this embodiment, the image capturing device S6 includes a front camera S6F that captures an image of a space in front of the shovel 100, a left camera S6L that captures an image of a space to the left of the shovel 100, a right camera S6R that captures an image of a space to the right of the shovel 100, and a back camera S6B that captures an image of a space behind the shovel 100.

The image capturing device S6 is, for example, a monocular camera including an imaging device such as a CCD or a CMOS, and outputs captured images to the display device 40. The image capturing device S6 may also be a stereo camera, a distance image camera, or the like.

The front camera S6F is attached to, for example, the ceiling of the cabin 10, namely, the inside of the cabin 10. The front camera S6F may alternatively be attached to the outside of the cabin 10, such as the roof of the cabin 10 or the side of the boom 4. The left camera S6L is attached to the left end of the upper surface of the upper turning body 3. The right camera S6R is attached to the right end of the upper surface of the upper turning body 3. The back camera S6B is attached to the back end of the upper surface of the upper turning body 3.

The communications device T1 is configured to control communications with external apparatuses outside the shovel 100. According to this embodiment, the communications device T1 controls communications with external apparatuses via at least one of a satellite communications network, a cellular phone network, the Internet, etc.

Figure 2:
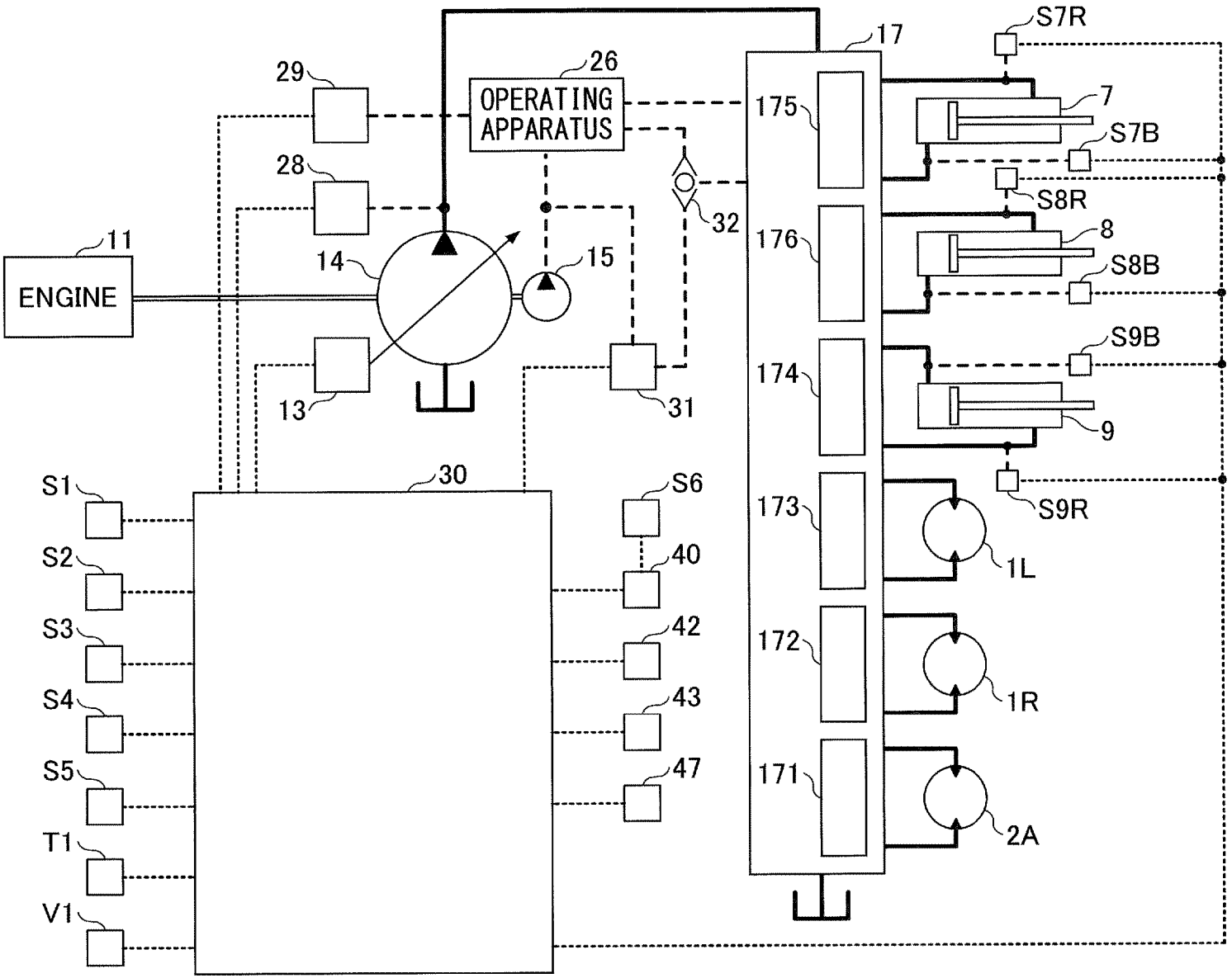
FIG. 2 is a diagram illustrating an example configuration of a drive system of the shovel of FIG. 1.

FIG. 2 is a block diagram illustrating an example configuration of the drive system of the shovel 100, in which a mechanical power transmission line, a hydraulic oil line, a pilot line, and an electric control line are indicated by a double line, a solid line, a dashed line, and a dotted line, respectively.

The drive system of the shovel 100 mainly includes the engine 11, a regulator 13, a main pump 14, a pilot pump 15, a control valve 17, an operating apparatus 26, a discharge pressure sensor 28, an operating pressure sensor 29, the controller 30, a proportional valve 31, and a shuttle valve 32.

The engine 11 is a drive source of the shovel 100. According to this embodiment, the engine 11 is a diesel engine that so operates as to maintain a predetermined rotational speed. The output shaft of the engine 11 is coupled to the input shafts of the main pump 14 and the pilot pump 15.

The main pump 14 is configured to supply hydraulic oil to the control valve 17 via a hydraulic oil line. According to this embodiment, the main pump 14 is a swash plate variable displacement hydraulic pump.

The regulator 13 is configured to control the discharge quantity of the main pump 14. According to this embodiment, the regulator 13 controls the discharge quantity of the main pump 14 by adjusting the swash plate tilt angle of the main pump 14 in response to a control command from the controller 30. For example, the controller 30 varies the discharge quantity of the main pump 14 by outputting a control command to the regulator 13 in accordance with the output of the operating pressure sensor 29 or the like.

The pilot pump 15 is configured to supply hydraulic oil to various hydraulic control apparatuses including the operating apparatus 26 and the proportional valve 31 via a pilot line. According to this embodiment, the pilot pump 15 is a fixed displacement hydraulic pump. The pilot pump 15, however, may be omitted. In this case, the function carried by the pilot pump 15 may be implemented by the main pump 14. That is, the main pump 14 may have the function of supplying hydraulic oil to the operating apparatus 26, the proportional valve 31, etc., after reducing the pressure of the hydraulic oil with a throttle or the like, apart from the function of supplying hydraulic oil to the control valve 17.

The control valve 17 is a hydraulic control device that controls a hydraulic system in the shovel 100. According to this embodiment, the control valve 17 includes control valves 171 through 176. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to hydraulic actuators and the flow rate of hydraulic oil flowing from hydraulic actuators to a hydraulic oil tank. The hydraulic actuators include the boom cylinder 7, the arm cylinder 8, the bucket cylinder 9, a left traveling hydraulic motor 1L, a right traveling hydraulic motor 1R, and a turning hydraulic motor 2A. The turning hydraulic motor 2A may alternatively be a turning electric motor serving as an electric actuator.

The operating apparatus 26 is an apparatus that the operator uses to operate actuators. The actuators include at least one of a hydraulic actuator and an electric actuator. According to this embodiment, the operating apparatus 26 supplies hydraulic oil discharged by the pilot pump 15 to a pilot port of a corresponding control valve in the control valve 17 via a pilot line. The pressure of hydraulic oil supplied to each pilot port (pilot pressure) is, in principle, a pressure commensurate with the direction of operation and the amount of operation of the operating apparatus 26 for a corresponding hydraulic actuator. At least one of the operating apparatus 26 is configured to be able to supply hydraulic oil discharged by the pilot pump 15 to a pilot port of a corresponding control valve in the control valve 17 via a pilot line and the shuttle valve 32. The operating apparatus 26, however, may also be configured to operate the control valves 171 through 176 using an electrical signal. In this case, the control valves 171 through 176 may be constituted of solenoid spool valves.

The discharge pressure sensor 28 is configured to detect the discharge pressure of the main pump 14. According to this embodiment, the discharge pressure sensor 28 outputs the detected value to the controller 30.

The operating pressure sensor 29 is configured to detect the details of the operator's operation using the operating apparatus 26. According to this embodiment, the operating pressure sensor 29 detects the direction of operation and the amount of operation of the operating apparatus 26 corresponding to each actuator in the form of pressure and outputs the detected value to the controller 30. The operation details of the operating apparatus 26 may be detected using a sensor other than an operating pressure sensor.

The proportional valve 31 is placed in a conduit connecting the pilot pump 15 and the shuttle valve 32, and is configured to be able to change the flow area of the conduit. According to this embodiment, the proportional valve 31 operates in response to a control command output by the controller 30. Therefore, the controller 30 can supply hydraulic oil discharged by the pilot pump 15 to a pilot port of a corresponding control valve in the control valve 17 via the proportional valve 31 and the shuttle valve 32, independent of the operator's operation of the operating apparatus 26.

The shuttle valve 32 includes two inlet ports and one outlet port. Of the two inlet ports, one is connected to the operating apparatus and the other is connected to the proportional valve 31. The outlet port is connected to a pilot port of a corresponding control valve in the control valve 17. Therefore, the shuttle valve 32 can cause the higher one of a pilot pressure generated by the operating apparatus 26 and a pilot pressure generated by the proportional valve 31 to act on a pilot port of a corresponding control valve.

According to this configuration, the controller 30 can operate a hydraulic actuator corresponding to a specific operating apparatus 26 even when no operation is performed on the specific operating apparatus 26.

Figure 3:
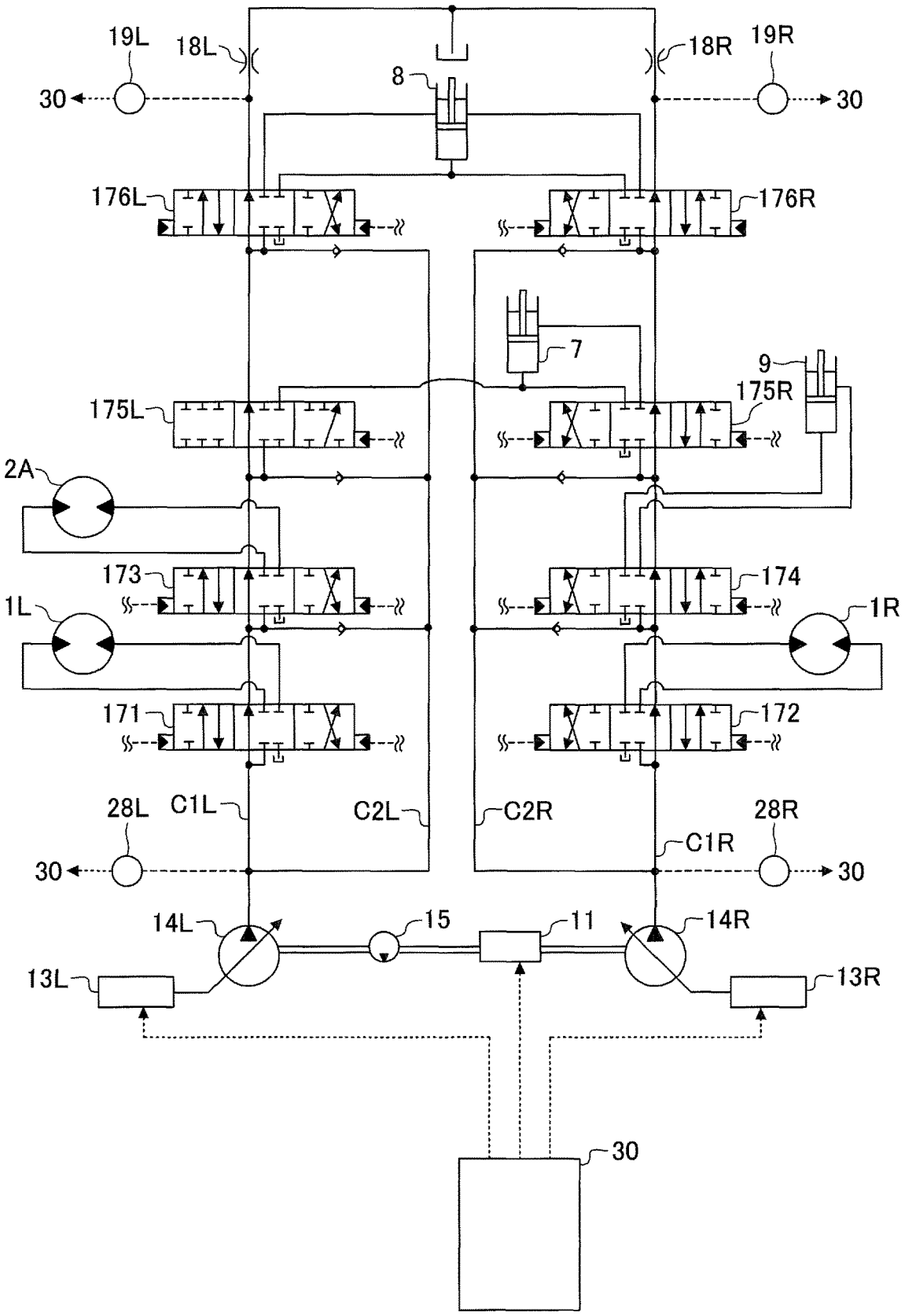
FIG. 3 is a schematic diagram illustrating an example configuration of a hydraulic system installed in the shovel of FIG. 1.

Next, an example configuration of a hydraulic system installed in the shovel 100 is described with reference to FIG. 3. FIG. 3 is a schematic diagram illustrating an example configuration of the hydraulic system installed in the shovel 100 of FIG. 1. In FIG. 3, a mechanical power transmission line, a hydraulic oil line, a pilot line, and an electric control line are indicated by a double line, a solid line, a dashed line, and a dotted line, respectively, the same as in FIG. 2.

The hydraulic system circulates hydraulic oil from main pumps 14L and 14R driven by the engine 11 to the hydraulic oil tank via center bypass conduits C1L and C1R or parallel conduits C2L and C2R. The main pumps 14L and 14R correspond to the main pump 14 of FIG. 2.

The center bypass conduit C1L, is a hydraulic oil line that passes through the control valves 171 and 173 and control valves 175L and 176L placed in the control valve 17. The center bypass conduit C1R is a hydraulic oil line that passes through the control valves 172 and 174 and control valves 175R and 176R placed in the control valve 17. The control valves 175L and 175R correspond to the control valve 175 of FIG. 2. The control valves 176L and 176R correspond to the control valve 176 of FIG. 2.

The control valve 171 is a spool valve that switches the flow of hydraulic oil in order to supply hydraulic oil discharged by the main pump 14L to the left traveling hydraulic motor 1L and to discharge hydraulic oil discharged by the left traveling hydraulic motor 1L to the hydraulic oil tank.

The control valve 172 is a spool valve that switches the flow of hydraulic oil in order to supply hydraulic oil discharged by the main pump 14R to the right traveling hydraulic motor 1R and to discharge hydraulic oil discharged by the right traveling hydraulic motor 1R to the hydraulic oil tank.

The control valve 173 is a spool valve that switches the flow of hydraulic oil in order to supply hydraulic oil discharged by the main pump 14L to the turning hydraulic motor 2A and to discharge hydraulic oil discharged by the turning hydraulic motor 2A to the hydraulic oil tank.

The control valve 174 is a spool valve that switches the flow of hydraulic oil in order to supply hydraulic oil discharged by the main pump 14R to the bucket cylinder 9 and to discharge hydraulic oil in the bucket cylinder 9 to the hydraulic oil tank.

The control valve 175L is a spool valve that switches the flow of hydraulic oil in order to supply hydraulic oil discharged by the main pump 14L to the boom cylinder 7. The control valve 175R is a spool valve that switches the flow of hydraulic oil in order to supply hydraulic oil discharged by the main pump 14R to the boom cylinder 7 and to discharge hydraulic oil in the boom cylinder 7 to the hydraulic oil tank.

The control valve 176L is a spool valve that switches the flow of hydraulic oil in order to supply hydraulic oil discharged by the main pump 14L to the arm cylinder 8 and to discharge hydraulic oil in the arm cylinder 8 to the hydraulic oil tank. The control valve 176R is a spool valve that switches the flow of hydraulic oil in order to supply hydraulic oil discharged by the main pump 14R to the arm cylinder 8 and to discharge hydraulic oil in the arm cylinder 8 to the hydraulic oil tank.

The parallel conduit C2L is a hydraulic oil line parallel to the center bypass conduit C1L. When the flow of hydraulic oil through the center bypass conduit C1L is restricted or blocked by at least one of the control valves 171, 173 and 175L, the parallel conduit C2L can supply hydraulic oil to a control valve further downstream. The parallel conduit C2R is a hydraulic oil line parallel to the center bypass conduit C1R. When the flow of hydraulic oil through the center bypass conduit C1R is restricted or blocked by at least one of the control valves 172, 174 and 175R, the parallel conduit C2R can supply hydraulic oil to a control valve further downstream.

A regulator 13L controls the discharge quantity of the main pump 14L by adjusting the swash plate tilt angle of the main pump 14L in accordance with the discharge pressure of the main pump 14L or the like. A regulator 13R controls the discharge quantity of the main pump 14R by adjusting the swash plate tilt angle of the main pump 14R in accordance with the discharge pressure of the main pump 14R or the like. The regulator 13L and the regulator 13R correspond to the regulator 13 of FIG. 2. The regulator 13L, for example, reduces the discharge quantity of the main pump 14L by adjusting its swash plate tilt angle, according as the discharge pressure of the main pump 14L increases. The same is the case with the regulator 13R. This is for preventing the absorbed power (absorbed horsepower) of the main pump 14 expressed by the product of the discharge pressure and the discharge quantity from exceeding the output power (output horsepower) of the engine 11.

A discharge pressure sensor 28L, which is an example of the discharge pressure sensor 28, detects the discharge pressure of the main pump 14L, and outputs the detected value to the controller 30. The same is the case with a discharge pressure sensor 28R.

Here, negative control adopted in the hydraulic system of FIG. 3 is described.

A throttle 18L is placed between the most downstream control valve 176L and the hydraulic oil tank in the center bypass conduit C1L. The flow of hydraulic oil discharged by the main pump 14L is restricted by the throttle 18L. The throttle 18L generates a control pressure for controlling the regulator 13L. A control pressure sensor 19L is a sensor for detecting the control pressure, and outputs the detected value to the controller 30.

A throttle 18R is placed between the most downstream control valve 176R and the hydraulic oil tank in the center bypass conduit C1R. The flow of hydraulic oil discharged by the main pump 14R is restricted by the throttle 18R. The throttle 18R generates a control pressure for controlling the regulator 13R. A control pressure sensor 19R is a sensor for detecting the control pressure, and outputs the detected value to the controller 30.

The controller 30 controls the discharge quantity of the main pump 14L by adjusting the swash plate tilt angle of the main pump 14L in accordance with the control pressure detected by the control pressure sensor 19L or the like. The controller 30 decreases the discharge quantity of the main pump 14L as the control pressure increases, and increases the discharge quantity of the main pump 14L as the control pressure decreases. Likewise, the controller 30 controls the discharge quantity of the main pump 14R by adjusting the swash plate tilt angle of the main pump 14R in accordance with the control pressure detected by the control pressure sensor 19R or the like. The controller 30 decreases the discharge quantity of the main pump 14R as the control pressure increases, and increases the discharge quantity of the main pump 14R as the control pressure decreases.

Specifically, as illustrated in FIG. 3, in a standby state where none of the hydraulic actuators is operated in the shovel 100, hydraulic oil discharged by the main pump 14L arrives at the throttle 18L through the center bypass conduit C1L. The flow of hydraulic oil discharged by the main pump 14L increases the control pressure generated upstream of the throttle 18L. As a result, the controller 30 decreases the discharge quantity of the main pump 14L to a minimum allowable discharge quantity to reduce pressure loss (pumping loss) during the passage of the discharged hydraulic oil through the center bypass conduit C1L. Likewise, in the standby state, hydraulic oil discharged by the main pump 14R arrives at the throttle 18R through the center bypass conduit C1R. The flow of hydraulic oil discharged by the main pump 14R increases the control pressure generated upstream of the throttle 18R. As a result, the controller 30 decreases the discharge quantity of the main pump 14R to a minimum allowable discharge quantity to reduce pressure loss (pumping loss) during the passage of the discharged hydraulic oil through the center bypass conduit C1R.

In contrast, when any of the hydraulic actuators is operated, hydraulic oil discharged by the main pump 14L flows into the operated hydraulic actuator via a control valve corresponding to the operated hydraulic actuator. The flow of hydraulic oil discharged by the main pump 14L that arrives at the throttle 18L is reduced in amount or lost, so that the control pressure generated upstream of the throttle 18L is reduced. As a result, the controller 30 increases the discharge quantity of the main pump 14L to circulate sufficient hydraulic oil to the operated hydraulic actuator to ensure driving of the operated hydraulic actuator. Likewise, when any of the hydraulic actuators is operated, hydraulic oil discharged by the main pump 14R flows into the operated hydraulic actuator via a control valve corresponding to the operated hydraulic actuator. The flow of hydraulic oil discharged by the main pump 14R that arrives at the throttle 18R is reduced in amount or lost, so that the control pressure generated upstream of the throttle 18R is reduced. As a result, the controller 30 increases the discharge quantity of the main pump 14R to circulate sufficient hydraulic oil to the operated hydraulic actuator to ensure driving of the operated hydraulic actuator.

According to the configuration as described above, the hydraulic system of FIG. 3 can reduce unnecessary energy consumption in the main pump 14L and the main pump 14R in the standby state. The unnecessary energy consumption includes pumping loss that hydraulic oil discharged by the main pump 14L causes in the center bypass conduit C1L and pumping loss that hydraulic oil discharged by the main pump 14R causes in the center bypass conduit C1R. Furthermore, in the case of actuating hydraulic actuators, the hydraulic system of FIG. 3 can supply necessary and sufficient hydraulic oil from the main pump 14L and the main pump 14R to hydraulic actuators to be actuated.

Figure 4A:
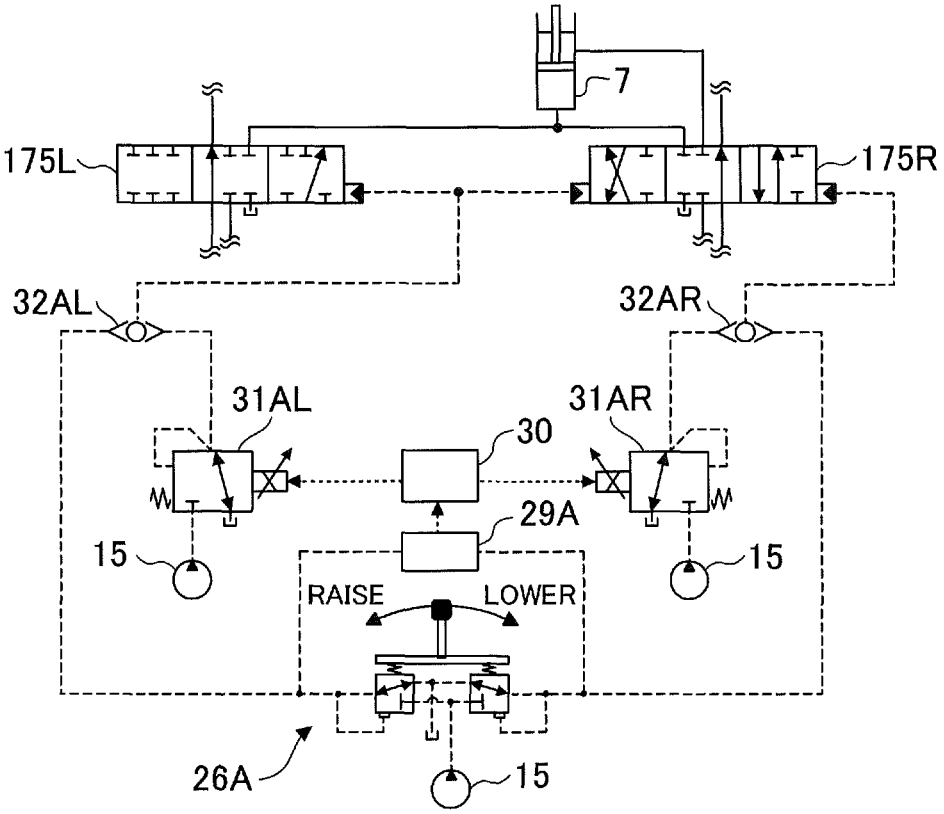
FIG. 4A is a diagram extracting part of the hydraulic system installed in the shovel of FIG. 1.
Figure 4B:
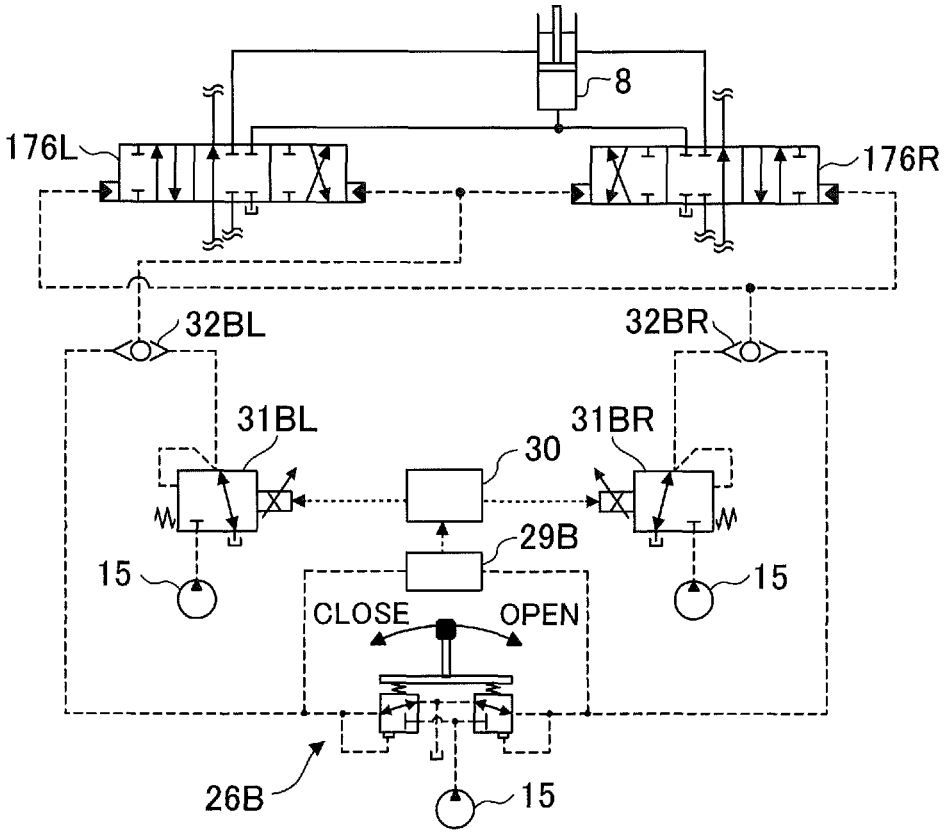
FIG. 4B is a diagram extracting part of the hydraulic system installed in the shovel of FIG. 1.
Figure 4C:
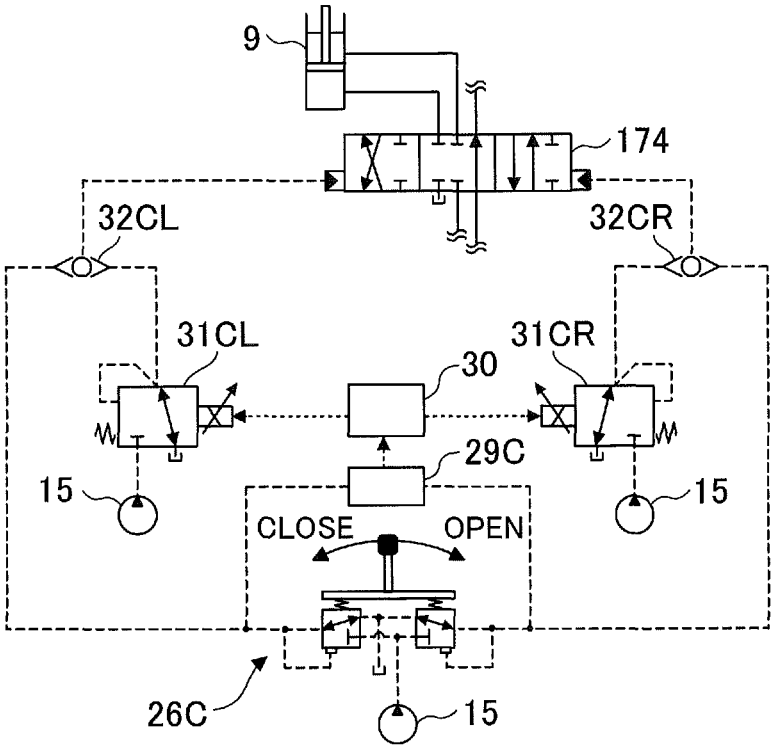
FIG. 4C is a diagram extracting part of the hydraulic system installed in the shovel of FIG. 1.

Next, a configuration for causing an actuator to automatically operate is described with reference to FIGS. 4A through 4C. FIGS. 4A through 4C are diagrams extracting part of the hydraulic system. Specifically, FIG. 4A is a diagram extracting part of the hydraulic system related to the operation of the boom cylinder 7. FIG. 4B is a diagram extracting part of the hydraulic system related to the operation of the arm cylinder 8. FIG. 4C is a diagram extracting part of the hydraulic system related to the operation of the bucket cylinder 9.

A boom operating lever 26A in FIG. 4A is an example of the operating apparatus 26 and is used to operate the boom 4. The boom operating lever 26A uses hydraulic oil discharged by the pilot pump 15 to cause a pilot pressure commensurate with the details of an operation to act on respective pilot ports of the control valve 175L and the control valve 175R. Specifically, when operated in a boom raising direction, the boom operating lever 26A causes a pilot pressure commensurate with the amount of operation to act on the right pilot port of the control valve 175L and the left pilot port of the control valve 175R. When operated in a boom lowering direction, the boom operating lever 26A causes a pilot pressure commensurate with the amount of operation to act on the right pilot port of the control valve 175R.

An operating pressure sensor 29A, which is an example of the operating pressure sensor 29, detects the details of the operator's operation of the boom operating lever 26A in the form of pressure, and outputs the detected value to the controller 30. Examples of the operation details include the direction of operation and the amount of operation (the angle of operation).

A proportional valve 31AL and a proportional valve 31AR are examples of the proportional valve 31. A shuttle valve 32AL and a shuttle valve 32AR are examples of the shuttle valve 32. The proportional valve 31AL operates in response to a current command output by the controller 30. The proportional valve 31AL controls a pilot pressure due to hydraulic oil introduced to the right pilot port of the control valve 175L and the left pilot port of the control valve 175R from the pilot pump 15 via the proportional valve 31AL and the shuttle valve 32AL. The proportional valve 31AR operates in response to a current command output by the controller 30. The proportional valve 31AR controls a pilot pressure due to hydraulic oil introduced to the right pilot port of the control valve 175R from the pilot pump 15 through the proportional valve 31AR and the shuttle valve 32AR. The proportional valve 31AL can control the pilot pressure such that the control valve 175L and the control valve 175R can stop at a desired valve position. The proportional valve 31AR can control the pilot pressure such that the control valve 175R can stop at a desired valve position.

According to this configuration, the controller 30 can supply hydraulic oil discharged by the pilot pump 15 to the right pilot port of the control valve 175L and the left pilot port of the control valve 175R through the proportional valve 31AL and the shuttle valve 32AL, independent of the operator's boom raising operation. That is, the controller 30 can automatically raise the boom 4. Furthermore, the controller 30 can supply hydraulic oil discharged by the pilot pump 15 to the right pilot port of the control valve 175R through the proportional valve 31AR and the shuttle valve 32AR, independent of the operator's boom lowering operation. That is, the controller 30 can automatically lower the boom 4.

An arm operating lever 26B in FIG. 4B is another example of the operating apparatus 26 and is used to operate the arm 5. The arm operating lever 26B uses hydraulic oil discharged by the pilot pump 15 to cause a pilot pressure commensurate with the details of an operation to act on respective pilot ports of the control valve 176L and the control valve 176R. Specifically, when operated in an arm closing direction, the arm operating lever 26B causes a pilot pressure commensurate with the amount of operation to act on the right pilot port of the control valve 176L and the left pilot port of the control valve 176R. When operated in an arm opening direction, the arm operating lever 26B causes a pilot pressure commensurate with the amount of operation to act on the left pilot port of the control valve 176L and the right pilot port of the control valve 176R.

An operating pressure sensor 29B, which is another example of the operating pressure sensor 29, detects the details of the operator's operation of the arm operating lever 26B in the form of pressure, and outputs the detected value to the controller 30. Examples of the operation details include the direction of operation and the amount of operation (the angle of operation).

A proportional valve 31BL and a proportional valve 31BR are other examples of the proportional valve 31. A shuttle valve 32BL and a shuttle valve 32BR are other examples of the shuttle valve 32. The proportional valve 31BL operates in response to a current command output by the controller 30. The proportional valve 31BL controls a pilot pressure due to hydraulic oil introduced to the right pilot port of the control valve 176L and the left pilot port of the control valve 176R from the pilot pump 15 via the proportional valve 31BL and the shuttle valve 32BL. The proportional valve 31BR operates in response to a current command output by the controller 30. The proportional valve 31BR controls a pilot pressure due to hydraulic oil introduced to the left pilot port of the control valve 176L and the right pilot port of the control valve 176R from the pilot pump 15 via the proportional valve 31BR and the shuttle valve 32BR. Each of the proportional valve 31BL and the proportional valve 31BR can control the pilot pressure such that the control valve 176L and the control valve 176R can stop at a desired valve position.

According to this configuration, the controller 30 can supply hydraulic oil discharged by the pilot pump 15 to the right side pilot port of the control valve 176L and the left side pilot port of the control valve 176R through the proportional valve 31BL and the shuttle valve 32BL, independent of the operator's arm closing operation. That is, the controller 30 can automatically close the arm 5. Furthermore, the controller 30 can supply hydraulic oil discharged by the pilot pump 15 to the left side pilot port of the control valve 176L and the right side pilot port of the control valve 176R through the proportional valve 31BR and the shuttle valve 32BR, independent of the operator's arm opening operation. That is, the controller 30 can automatically open the arm 5.

A bucket operating lever 26C in FIG. 4C is yet another example of the operating apparatus 26 and is used to operate the bucket 6. The bucket operating lever 26C uses hydraulic oil discharged by the pilot pump 15 to cause a pilot pressure commensurate with the details of an operation to act on a pilot port of the control valve 174. Specifically, when operated in a bucket opening direction, the bucket operating lever 26C causes a pilot pressure commensurate with the amount of operation to act on the right pilot port of the control valve 174. When operated in a bucket closing direction, the bucket operating lever 26C causes a pilot pressure commensurate with the amount of operation to act on the left pilot port of the control valve 174.

An operating pressure sensor 29C, which is yet another example of the operating pressure sensor 29, detects the details of the operator's operation of the bucket operating lever 26C in the form of pressure, and outputs the detected value to the controller 30.

A proportional valve 31CL and a proportional valve 31CR are yet other examples of the proportional valve 31. A shuttle valve 32CL and a shuttle valve 32CR are yet other examples of the shuttle valve 32. The proportional valve 31CL operates in response to a current command output by the controller 30. The proportional valve 31CL controls a pilot pressure due to hydraulic oil introduced to the left pilot port of the control valve 174 from the pilot pump 15 via the proportional valve 31CL and the shuttle valve 32CL. The proportional valve 31CR operates in response to a current command output by the controller 30. The proportional valve 31CR controls a pilot pressure due to hydraulic oil introduced to the right pilot port of the control valve 174 from the pilot pump 15 via the proportional valve 31CR and the shuttle valve 32CR. Each of the proportional valve 31CL and the proportional valve 31CR can control the pilot pressure such that the control valve 174 can stop at a desired valve position.

According to this configuration, the controller 30 can supply hydraulic oil discharged by the pilot pump 15 to the left side pilot port of the control valve 174 through the proportional valve 31CL and the shuttle valve 32CL, independent of the operator's bucket closing operation. That is, the controller 30 can automatically close the bucket 6. Furthermore, the controller 30 can supply hydraulic oil discharged by the pilot pump 15 to the right side pilot port of the control valve 174 through the proportional valve 31CR and the shuttle valve 32CR, independent of the operator's bucket opening operation. That is, the controller 30 can automatically open the bucket 6.

The shovel 100 may also be configured to automatically turn the upper turning body 3 and be configured to automatically move the lower traveling body 1 forward and backward. In this case, part of the hydraulic system related to the operation of the turning hydraulic motor 2A, part of the hydraulic system related to the operation of the left traveling hydraulic motor 1L, and part of the hydraulic system related to the operation of the right traveling hydraulic motor 1R may be configured the same as part of the hydraulic system related to the operation of the boom cylinder 7, etc.

Figure 5:
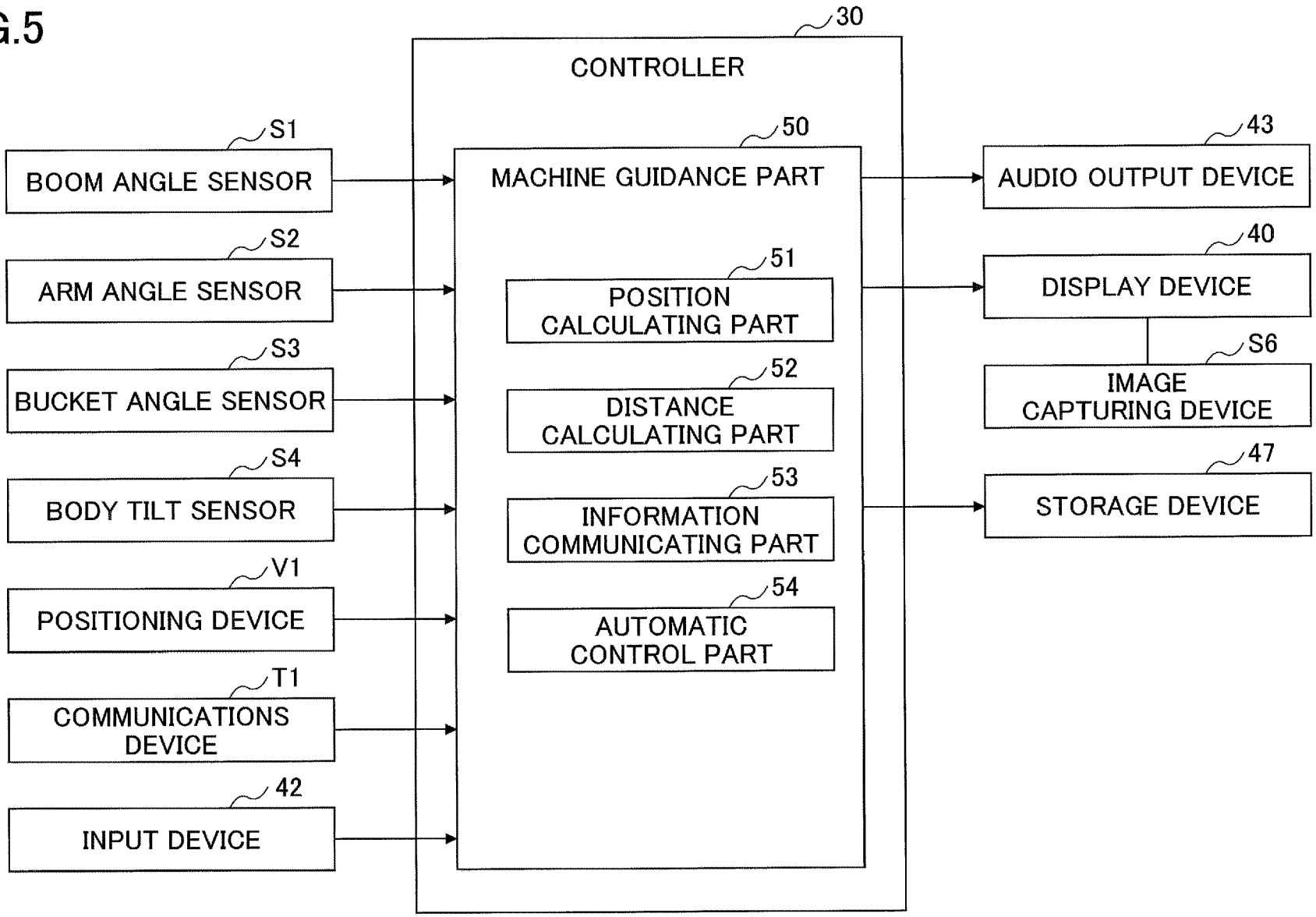
FIG. 5 is a diagram illustrating an example configuration of a machine guidance part.

Next, the machine guidance part 50 included in the controller 30 is described with reference to FIG. 5. The machine guidance part 50 is, for example, configured to execute the machine guidance function. According to this embodiment, for example, the machine guidance part 50 notifies the operator of work information such as the distance between the intended work surface and the working part of the attachment. Data on the intended work surface are, for example, data on a work surface at the time of completion of work, and are prestored in the storage device 47. The data on the intended work surface are expressed in, for example, a reference coordinate system. The reference coordinate system is, for example, the world geodetic system. The world geodetic system is a three-dimensional Cartesian coordinate system with the origin at the center of mass of the Earth, the X-axis oriented toward the point of intersection of the prime meridian and the equator, the Y-axis oriented toward 90 degrees east longitude, and the Z-axis oriented toward the Arctic pole. The operator may set any point at a work site as a reference point and set the intended work surface based on the relative positional relationship between each point of the intended work surface and the reference point. The working part of the attachment is, for example, the teeth tips of the bucket 6, the back surface of the bucket 6, or the like. The machine guidance part 50 provides guidance on operating the shovel 100 by notifying the operator of work information via at least one of the display device 40, the audio output device 43, etc.

The machine guidance part 50 may execute the machine control function to automatically assist the operator in manually operating the shovel 100 directly or manually operating the shovel 100 remotely. For example, when the operator is manually performing operation for excavation, the machine guidance part 50 may cause at least one of the boom 4, the arm 5, and the bucket 6 to automatically operate such that the leading edge position of the bucket 6 coincides with the intended work surface. The machine guidance part 50 may also execute the automatic control function to implement unmanned operation of the shovel 100.

While incorporated into the controller 30 according to this embodiment, the machine guidance part 50 may be a control device provided separately from the controller 30. In this case, for example, like the controller 30, the machine guidance part 50 is constituted of a computer including a CPU and an internal memory, and the CPU executes programs stored in the internal memory to implement various functions of the machine guidance part 50. The machine guidance part 50 and the controller 30 are connected by a communications network such as a CAN to be able to communicate with each other.

Specifically, the machine guidance part 50 obtains information from the boom angle sensor S1, the arm angle sensor S2, the bucket angle sensor S3, the body tilt sensor S4, the turning angular velocity sensor S5, the image capturing device S6, the positioning device V1, the communications device T1, the input device 42, etc. Then, the machine guidance part 50, for example, calculates the distance between the bucket 6 and the intended work surface based on the obtained information, and notifies the operator of the size of the distance between the bucket 6 and the intended work surface through audio and image display. Therefore, the machine guidance part 50 includes a position calculating part 51, a distance calculating part 52, an information communicating part 53, and an automatic control part 54.

The position calculating part 51 is configured to calculate the position of an object whose location is to be determined. According to this embodiment, the position calculating part 51 calculates the coordinate point of the working part of the attachment in the reference coordinate system. Specifically, the position calculating part 51 calculates the coordinate point of the teeth tips of the bucket 6 from the respective rotation angles of the boom 4, the arm 5, and the bucket 6.

The distance calculating part 52 is configured to calculate the distance between two objects whose locations are to be determined. According to this embodiment, the distance calculating part 52 calculates the vertical distance between the teeth tips of the bucket 6 and the intended work surface.

The information communicating part 53 is configured to communicate various kinds of information to the operator of the shovel 100. According to this embodiment, the information communicating part 53 notifies the operator of the shovel 100 of the size of each of the various distances calculated by the distance calculating part 52. Specifically, the information communicating part 53 notifies the operator of the shovel 100 of the size of the vertical distance between the teeth tips of the bucket 6 and the intended work surface, using at least one of visual information and aural information.

For example, the information communicating part 53 may notify the operator of the size of the vertical distance between the teeth tips of the bucket 6 and the intended work surface, using intermittent sounds through the audio output device 43. In this case, the information communicating part 53 may reduce the interval between intermittent sounds as the vertical distance decreases. The information communicating part 53 may use a continuous sound and may represent variations in the size of the vertical distance by changing at least one of the pitch, loudness, etc., of the sound. Furthermore, when the teeth tips of the bucket 6 are positioned lower than the intended work surface, the information communicating part 53 may issue an alarm. The alarm is, for example, a continuous sound significantly louder than the intermittent sounds.

The information communicating part 53 may display the size of the vertical distance between the teeth tips of the bucket 6 and the intended work surface on the display device 40 as work information. For example, the display device 40 displays the work information received from the information communicating part 53 on a screen, together with image data received from the image capturing device S6. The information communicating part 53 may notify the operator of the size of the vertical distance, using, for example, an image of an analog meter, an image of a bar graph indicator, or the like.

The automatic control part 54 is configured to assist the operator in manually operating the shovel 100 directly or manually operating the shovel 100 remotely by automatically moving hydraulic actuators. For example, the automatic control part 54 may automatically extend or retract at least one of the boom cylinder 7, the arm cylinder 8, and the bucket cylinder 9 such that the position of the teeth tips of the bucket 6 coincides with the intended work surface, while the operator is manually performing an arm closing operation. In this case, for example, only by operating an arm operating lever in a closing direction, the operator can close the arm 5 while making the teeth tips of the bucket 6 coincide with the intended work surface. This automatic control may be executed in response to the depression of a predetermined switch that is an input device included in the input device 42. The predetermined switch is, for example, a machine control switch, and may be placed at the end of the operating apparatus 26 as a knob switch.

The automatic control part 54 may automatically rotate the turning hydraulic motor 2A in order to oppose the upper turning body 3 squarely with the intended work surface. In this case, the operator can oppose the upper turning body 3 squarely with the intended work surface by only depressing the predetermined switch. Alternatively, the operator can oppose the upper turning body 3 squarely with the intended work surface and start the machine control function by only depressing the predetermined switch.

According to this embodiment, the automatic control part 54 can automatically move each actuator by individually and automatically controlling a pilot pressure that acts on a control valve corresponding to each actuator.

The automatic control part 54 may automatically extend or retract at least one of the boom cylinder 7, the arm cylinder 8, and the bucket cylinder 9 in order to assist in slope finishing work. The slope finishing work is the work of pulling the bucket 6 to the near side along the intended work surface while pressing the back surface of the bucket 6 against the ground. For example, while the operator is manually performing an arm closing operation, the automatic control part 54 automatically extends or retracts at least one of the boom cylinder 7, the arm cylinder 8, and the bucket cylinder 9, in order to move the bucket 6 along the intended work surface that is a finished slope while pressing the back surface of the bucket 6 against an inclined surface that is an unfinished slope with a predetermined pressing force. This automatic control associated with slope finishing (hereinafter, "slope finishing assist control") may be executed when a predetermined switch such as a slope finish switch is depressed. This slope finishing assist control enables the operator to perform the slope finishing work by only operating the arm operating lever 26B in a closing direction.

During the slope finishing work, a strong pressing force lifts the body of the shovel 100 and may displace the shovel 100 to adversely affect the subsequent machine control function, etc. In contrast, a weak pressing force results in formation of a soft slope. Furthermore, a force that the back surface of the bucket 6 exerts on the ground changes in accordance with the posture of the attachment. Therefore, it is difficult to maintain an appropriate pressing force during the slope finishing work through manual direct operation and manual remote operation. The automatic control part 54 can solve these problems with the slope finishing assist control.

Figure 6:
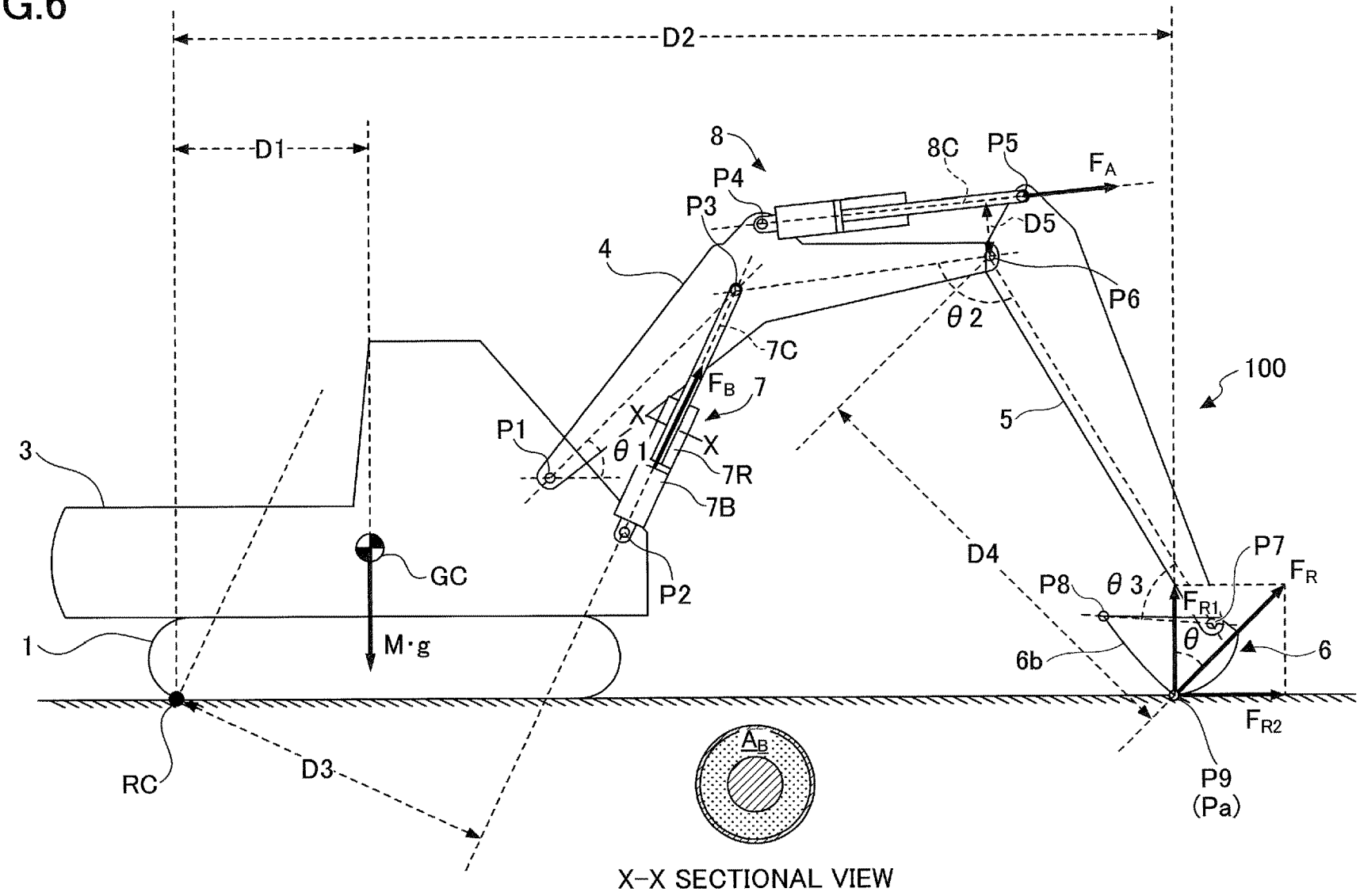
FIG. 6 is a schematic diagram illustrating the relationship between forces that act on the shovel.

Next, the controller 30's calculation of a work reaction force is described with reference to FIG. 6. FIG. 6 is a schematic diagram illustrating the relationship of forces that act on the shovel 100. According to the example of FIG. 6, when moving the working part along the intended work surface so that a ground shape is equal to the shape of the intended work surface (a horizontal surface in FIG. 6), the shovel 100 moves the boom 4 up and down in response to the closing movement of the arm 5. At this point, an arm thrust generated during the closing movement of the arm 5 is transmitted to the boom cylinder V. The relationship of forces when the arm thrust is transmitted to the boom cylinder 7 is described below.

In FIG. 6, Point P1 indicates the juncture of the upper turning body 3 and the boom 4, and Point P2 indicates the juncture of the upper turning body 3 and the cylinder of the boom cylinder 7. Furthermore, Point P3 indicates the juncture of a rod 7C of the boom cylinder 7 and the boom 4, and Point P4 indicates the juncture of the boom 4 and the cylinder of the arm cylinder 8. Furthermore, Point P5 indicates the juncture of a rod 8C of the arm cylinder 8 and the arm 5, and Point P6 indicates the juncture of the boom 4 and the arm 5. Furthermore, Point P7 indicates the juncture of the arm 5 and the bucket 6, Point P8 indicates the leading edge of the bucket 6, and Point P9 indicates a predetermined point Pa on a back surface 6*b* of the bucket 6. In FIG. 6, a graphical representation of the bucket cylinder 9 is omitted for clarification.

Furthermore, FIG. 6 illustrates the angle between a straight line that connects Point P1 and Point P3 and a horizontal line as a boom angle θ1, the angle between a straight line that connects Point P3 and Point P6 and a straight line that connects Point P6 and Point P7 as an arm angle θ2, and the angle between the straight line that connects Point P6 and Point P7 and a straight line that connects Point P7 and Point P8 as a bucket angle θ3.

Furthermore, in FIG. 6, a distance D1 indicates the horizontal distance between a center of rotation RC when a lift of the body occurs and the center of gravity GC of the shovel 100, that is, the distance between a straight line including the line of action of gravity M·g that is the product of a mass M of the shovel 100 and gravitational acceleration g and the center of rotation RC. The product of the distance D1 and the magnitude of the gravity M·g represents the magnitude of a first moment of force around the center of rotation RC. Here, a symbol "·" represents "×" (a multiplication sign).

The position of the center of rotation RC is determined based on, for example, the output of the turning angular velocity sensor S5. For example, when a turning angle that is the angle between the longitudinal axis of the lower traveling body 1 and the longitudinal axis of the upper turning body 3 is 0 degrees, the back end of a portion of the lower traveling body 1 contacting a contact ground surface serves as the center of rotation RC, and when the turning angle is 180 degrees, the front end of a portion of the lower traveling body 1 contacting a contact ground surface serves as the center of rotation RC. Furthermore, when the turning angle is 90 degrees or 270 degrees, the side end of a portion of the lower traveling body 1 contacting a contact ground surface serves as the center of rotation RC.

Furthermore, in FIG. 6, a distance D2 indicates the horizontal distance between the center of rotation RC and Point P9, that is, the distance between a straight line including the line of action of a component $F_{R1}$ of a work reaction force $F_R$ vertical to the ground (a horizontal surface in FIG. 6) and the center of rotation RC. A component $F_{R2}$ is a component of the work reaction force $F_R$ parallel to the ground. The product of the distance D2 and the magnitude of the component $F_{R1}$ represents the magnitude of a second moment of force around the center of rotation RC. According to the example of FIG. 6, the work reaction force $F_R$ forms a work angle θ relative to a vertical axis, and the component $F_{R1}$ of the work reaction force $F_R$ is expressed by $F_{R1}=F_R\cdot\cos\theta$. Furthermore, the work angle θ is calculated based on the boom angle θ1, the arm angle θ2, and the bucket angle θ3. The component $F_{R1}$ of the work reaction force $F_R$ vertical to the ground (a horizontal surface in FIG. 6) indicates that the ground is pressed in a direction perpendicular to the intended work surface.

Furthermore, in FIG. 6, a distance D3 indicates the distance between a straight line that connects Point P2 and Point P3 and the center of rotation RC, that is, the distance between a straight line including the line of action of a force $F_B$ to pull out the rod 7C of the boom cylinder 7 and the center of rotation RC. The product of the distance D3 and the magnitude of the force $F_B$ represents the magnitude of a third moment of force around the center of rotation RC. According to the example of FIG. 6, the force $F_B$ to pull out the rod 7C of the boom cylinder 7 is generated by the work reaction force $F_R$ that acts on Point P9, which is the predetermined point Pa on the back surface 6*b* of the bucket 6.

Furthermore, in FIG. 6, a distance D4 indicates the distance between a straight line including the line of action of the work reaction force $F_R$ and Point P6. The product of the distance D4 and the magnitude of the work reaction force $F_R$ represents the magnitude of a first moment of force around Point P6.

Furthermore, in FIG. 6, a distance D5 indicates the distance between a straight line that connects Point P4 and Point P5 and Point P6, that is, the distance between a straight line including the line of action of an arm thrust $F_A$ to close the arm 5 and Point P6. The product of the distance D5 and the magnitude of the arm thrust $F_A$ represents a second moment of force around Point P6.

Here, it is assumed that the magnitude of a moment of force to lift the shovel 100 around the center of rotation RC by the component $F_{R1}$ of the work reaction force $F_R$ is replaceable with the magnitude of a moment of force to lift the shovel 100 around the center of rotation RC by the force $F_B$ to pull out the rod 7C of the boom cylinder 7. In this case, the relationship between the magnitude of the second moment of force around the center of rotation RC and the magnitude of the third moment of force around the center of rotation RC is expressed by the following equation (1):

$$F_{R1}\cdot D2=F_R\cdot\cos\theta\cdot D2=F_B\cdot D3. \quad (1)$$

Furthermore, the magnitude of a moment of force to close the arm 5 around Point P6 by the arm thrust $F_A$ and the magnitude of a moment of force to open the arm 5 around Point P6 by the work reaction force $F_R$ are believed to balance out each other. In this case, the relationship between the magnitude of the first moment of force around Point P6 and the magnitude of the second moment of force around Point P6 is expressed by the following equation (2) and equation (2)':

$$F_A\cdot D5=F_R\cdot D4, \text{ and} \quad (2)$$

$$F_R=F_A\cdot D5/D4, \quad (2)'$$

where a symbol "/" represents "÷" (a division sign).

Furthermore, from Eq. (1) and Eq. (2), the force $F_B$ to pull out the rod 70 of the boom cylinder 7 is expressed by the following equation (3):

$$F_B=F_A\cdot D2\cdot D5\cdot\cos\theta/(D3\cdot D4). \quad (3)$$

Furthermore, letting the area of the annular pressure receiving surface of the piston of the boom cylinder 7 that faces the rod-side oil chamber 7R be an area $A_B$ as illustrated in the X-X cross-sectional view of FIG. 6, and letting the pressure of hydraulic oil in the rod-side oil chamber 7R be a boom rod pressure $P_B$, the force $F_B$ to pull out the rod 7C of the boom cylinder 7 is expressed by $F_B=P_B \cdot A_B$. Accordingly, Eq. (3) is expressed by the following equation (4) and equation (4)':

$$P_B=F_A \cdot D2 \cdot D5 \cdot \cos\theta/(A_B \cdot D3 \cdot D4), \text{ and} \quad (4)$$

$$F_A=P_g \cdot A_g \cdot D3 \cdot D4/(D2 \cdot D5 \cdot \cos\theta), \quad (4)'$$

where the boom rod pressure $P_B$ is based on the output of the boom rod pressure sensor S7R.

Furthermore, the distance D1 is a constant, and like the work angle θ, the distances D2 through D5 are values determined according to the posture of the excavation attachment, that is, the boom angle θ1, the arm angle θ2, and the bucket angle θ3. Specifically, the distance D2 is determined according to the boom angle θ1, the arm angle θ2, and the bucket angle θ3, the distance D3 is determined according to the boom angle θ1, the distance D4 is determined according to the bucket angle θ3, and the distance D5 is determined according to the arm angle θ2.

The controller 30 can calculate the work reaction force $F_R$ using the above-described equations. Furthermore, the controller 30 can calculate the magnitude of a component of the work reaction force $F_R$ vertical to a slope as the magnitude of a pressing force by calculating the work reaction force $F_R$ during the slope finishing work. The work reaction force $F_R$ produced by the atm thrust $F_A$ (see FIG. 6) serves as a force to pull out the rod 7C of the boom cylinder 7.

Figure 7:
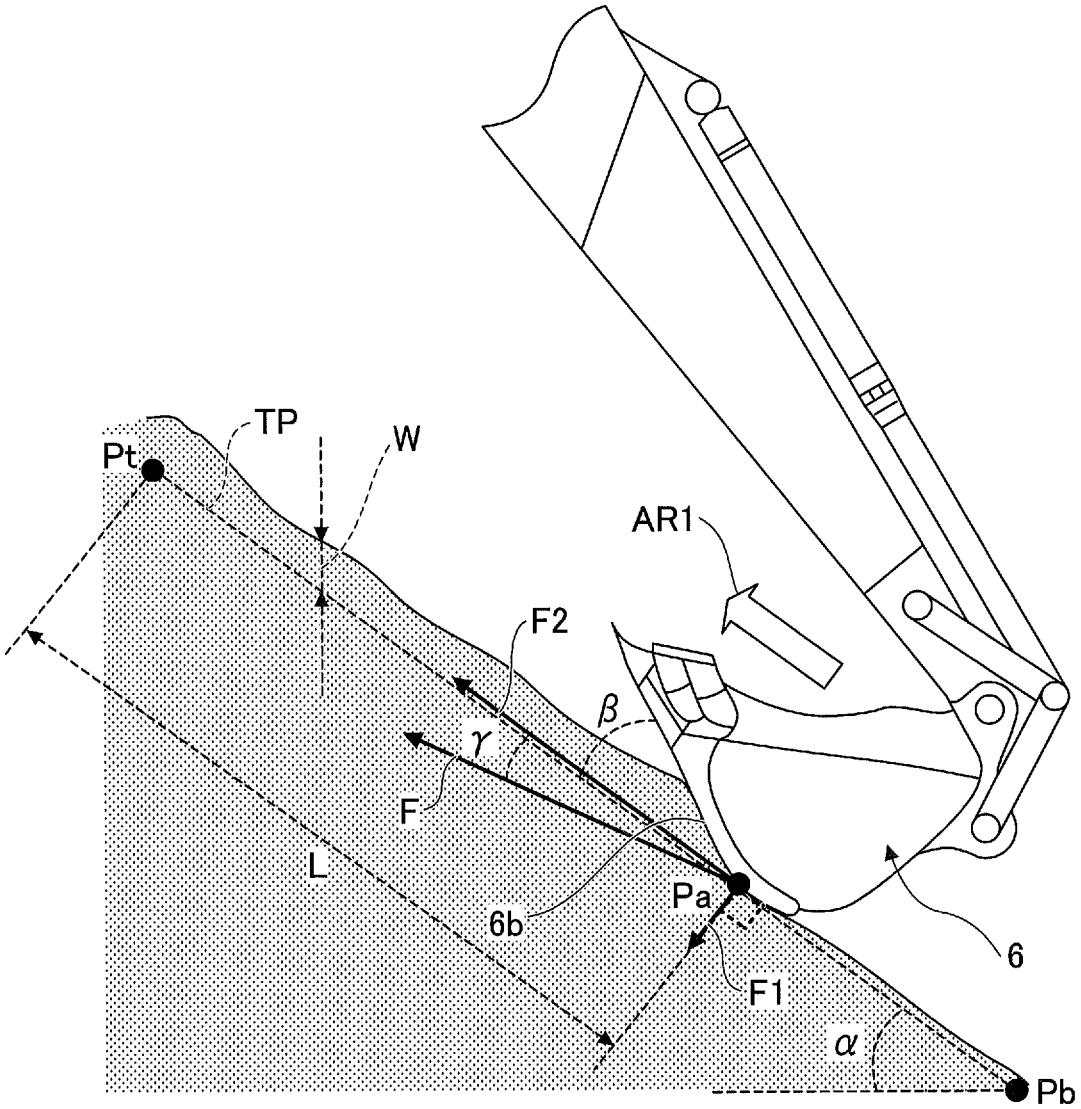
FIG. 7 is a side view of an attachment during slope finishing work.

Next, the slope finishing assist control is described in detail with reference to FIG. 7. FIG. 7 is a side view of the attachment during the slope finishing work and includes a vertical cross section of a slope.

When a slope is roughly finished, the operator of the shovel 100 causes the predetermined point Pa on the back surface 6*b* of the bucket 6 to coincide with an intended work surface TP at a position Pb corresponding to the toe of the slope in the intended work surface TP. "When the slope is roughly finished," the slope has soil of a certain thickness W remaining on the intended work surface TP as illustrated in FIG. 7. With the predetermined point Pa coinciding with or moved close to the intended work surface TP at the position Pb, the operator depresses the slope finish switch and operates the arm operating lever 26B in the arm closing direction. FIG. 7 illustrates a state after the arm operating lever 26B is operated in the atm closing direction.

The automatic control part 54 of the machine guidance part 50 starts the slope finishing assist control in response to the depression of the slope finish switch. The automatic control part 54 automatically extends or retracts at least one of the boom cylinder 7, the atm cylinder 8, and the bucket cylinder 9 in response to the operator's atm closing operation, in order to move the bucket 6 in a direction indicated by arrow AR1 while pressing the back surface 6*b* of the bucket 6 against the slope with a predetermined pressing force, that is, in order to move the predetermined point Pa on the back surface 6*b* of the bucket 6 along the intended work surface TP. Thus, the automatic control part 54 moves the predetermined point Pa on the back surface 6*b* of the bucket 6 in a direction along the intended work surface TP through position control or speed control commensurate with the amount of lever operation. In the case of position control, the automatic control part 54 moves the predetermined point Pa, setting a position more distant from the current predetermined point Pa on the intended work surface TP as a target position as the amount of lever operation becomes greater. In the case of speed control, the automatic control part 54 moves the predetermined point Pa, generating a speed command value such that the predetermined point Pa moves faster along the intended work surface TP as the amount of lever operation becomes greater. In a direction perpendicular to the intended work surface TP, the automatic control part 54 performs control such that the pressing force to press the predetermined point Pa on the back surface 6*b* of the bucket 6 against the ground has a predetermined value F1.

The automatic control part 54, for example, automatically increases the boom angle θ1 (see FIG. 6) as the arm closing operation decreases the arm angle θ2 (see FIG. 6) so that the predetermined point Pa moves along the intended work surface TP forming an angle α to a horizontal plane. That is, the automatic control part 54 automatically extends the boom cylinder 7. At this point, the automatic control part 54 may automatically increase the bucket angle θ3 (see FIG. 6) so that an angle β is maintained between the back surface 6*b* of the bucket 6 and the intended work surface TP. That is, the automatic control part 54 may automatically retract the bucket cylinder 9.

Thus, the automatic control part 54 can move the predetermined point Pa on the back surface 6*b* of the bucket 6 along the intended work surface TP while generating a force to vertically press the slope, by pulling up the bucket 6 while compressing soil between the ground and the back surface 6*b* of the bucket 6 so that the ground is pressed by the back surface 6*b* of the bucket 6 to be formed into the intended work surface TP.

Specifically, the automatic control part 54 operates the attachment such that the predetermined point Pa on the back surface 6*b* of the bucket 6 is pressed against the slope. For example, the automatic control part 54 operates the attachment such that the pressing force to vertically press the predetermined point Pa against the slope serving as the intended work surface TP is maintained at the predetermined value F1. The predetermined value F1 may be a value recorded in advance or may be a value input through the input device 42 or the like.

Thus, the automatic control part 54 can obtain information on irregularities of the ground by detecting changes in the posture of the attachment while moving the predetermined point Pa on the back surface 6*b* of the bucket 6 along the intended work surface TP with the pressing force in the direction perpendicular to the intended work surface TP being maintained at the predetermined value F1.

Figure 8:
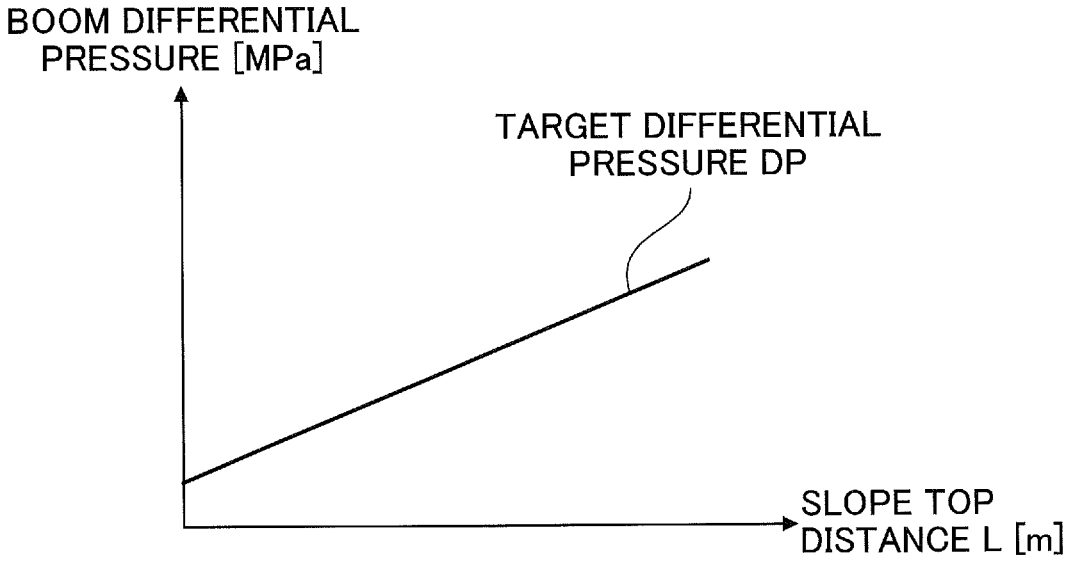
FIG. 8 is a graph illustrating an example of the relationship between a target differential pressure and a slope top distance.

As illustrated in FIG. 6, the work reaction force $F_R$ produced by the arm thrust $F_A$ serves as a force to pull out the rod 7C of the boom cylinder 7. Therefore, according to this embodiment, the automatic control part 54 controls the direction of movement of the predetermined point Pa so that the pressure difference between the boom rod pressure and the boom bottom pressure (hereinafter, "boom differential pressure") becomes a predetermined target differential pressure DP. As a result, the pressing force is maintained at the predetermined value F1. The target differential pressure DP changes according to the angle α of the intended work surface TP, the posture of the attachment, etc. FIG. 8 is a diagram illustrating an example of the relationship between the target differential pressure DP and a slope top distance L with respect to the intended work surface TP of the angle α. The slope top distance L is the distance between the top of the slope and the predetermined point Pa. A position Pt corresponding to the top of the slope (see FIG. 7) is, for example, preset as a coordinate point in the reference coordinate system. FIG. 8 illustrates a relationship where the target differential pressure DP decreases as the slope top distance L decreases, namely, as the bucket 6 approaches the body of the shovel 100. The relationship between the target differential pressure DP and the slope top distance L may be a non-linear relationship. Thus, the automatic control part 54 can maintain the pressing force at the predetermined value F1 by changing the target differential pressure DP according to the angle α of the intended work surface TP, the posture of the attachment, etc.

The automatic control part 54 calculates the slope top distance L from the current position of the predetermined point Pa calculated by the position calculating part 51, for example, at predetermined control intervals. The automatic control part 54 derives the target differential pressure DP corresponding to the slope top distance L, referring to a look-up table that stores the relationship as illustrated in FIG. 8. Furthermore, the automatic control part 54 derives the boom differential pressure from the respective detection values of the boom bottom pressure sensor S7B and the boom rod pressure sensor S7R. The automatic control part 54 determines the direction of movement of the predetermined point Pa on the back surface 6*b* of the bucket 6 from the difference between the boom differential pressure and the target differential pressure DP.

For example, when a current boom differential pressure is smaller than the target differential pressure DP, the automatic control part 54 determines the direction of movement of the predetermined point Pa so that an angle γ is formed between the direction of movement of the predetermined point Pa and the intended work surface TP as illustrated in FIG. 7. Furthermore, the automatic control part 54 determines the direction of movement of the predetermined point Pa so that the angle γ becomes greater as the boom differential pressure becomes smaller and smaller than the target differential pressure DP. The automatic control part 54 performs position control or speed control so that the bucket 6 moves in this direction of movement of the predetermined point Pa, in order that the pressing force in the direction perpendicular to the intended work surface TP applied to the intended work surface TP by the back surface 6*b* of the bucket 6 has the predetermined value F1. In this case, a force acting in a direction parallel to the intended work surface TP is F2. Furthermore, a resultant force F is the combined force of F2 that is a component parallel to the intended work surface TP and the pressing force in the direction perpendicular to the intended work surface TP (the predetermined value F1). That is, the automatic control part 54 moves the predetermined point Pa in a direction of an angle (a-y) smaller than the angle α relative to a horizontal plane when a current boom differential pressure is smaller than the target differential pressure DP.

When a current boom differential pressure is greater than the target differential pressure DP, the automatic control part 54 determines the direction of movement of the predetermined point Pa so that the angle γ has a negative value, that is, the direction of movement of the predetermined point Pa is oriented upward relative to the intended work surface TP. Furthermore, when a current boom differential pressure is equal to the target differential pressure DP, the automatic control part 54 determines the direction of movement of the predetermined point Pa so that the angle γ is zero, that is, the predetermined point Pa follows the intended work surface TP.

The automatic control part 54 may maintain the pressing force at the predetermined value F1 by controlling the attachment so that the pressure difference between the arm rod pressure and the arm bottom pressure (hereinafter, "arm differential pressure"), instead of the boom differential pressure to directly detect the arm thrust $F_A$, becomes a predetermined target differential pressure. Furthermore, the automatic control part 54 may also maintain the pressing force at the predetermined value F1 by controlling the attachment so that the pressure difference between the bucket rod pressure and the bucket bottom pressure, instead of the boom differential pressure, becomes a predetermined target differential pressure. The predetermined target differential pressure may be so set as to change according as the posture of the excavation attachment changes, so that the pressing force is maintained at the predetermined value F1 irrespective of a difference in the posture of the excavation attachment. Alternatively, the automatic control part 54 may maintain the pressing force at the predetermined value F1 by controlling the attachment so that a component of a work reaction force such as an excavation reaction force vertical to a slope becomes a predetermined target value. The work reaction force is calculated based on the boom angle, the arm angle, the bucket angle, the boom rod pressure, the area of the annular pressure receiving surface of the piston of the boom cylinder 7 that faces the rod-side oil chamber 7R, etc. Furthermore, the predetermined target value changes according to the angle α of the intended work surface, the posture of the attachment, etc.

Furthermore, the automatic control part 54 may maintain the pressing force at the predetermined value F1 as illustrated in FIG. 7 by controlling the attachment so that the component $F_{R1}$ of the work reaction force $F_R$ calculated during the slope finishing work vertical to the slope has a predetermined target value.

Figure 9:
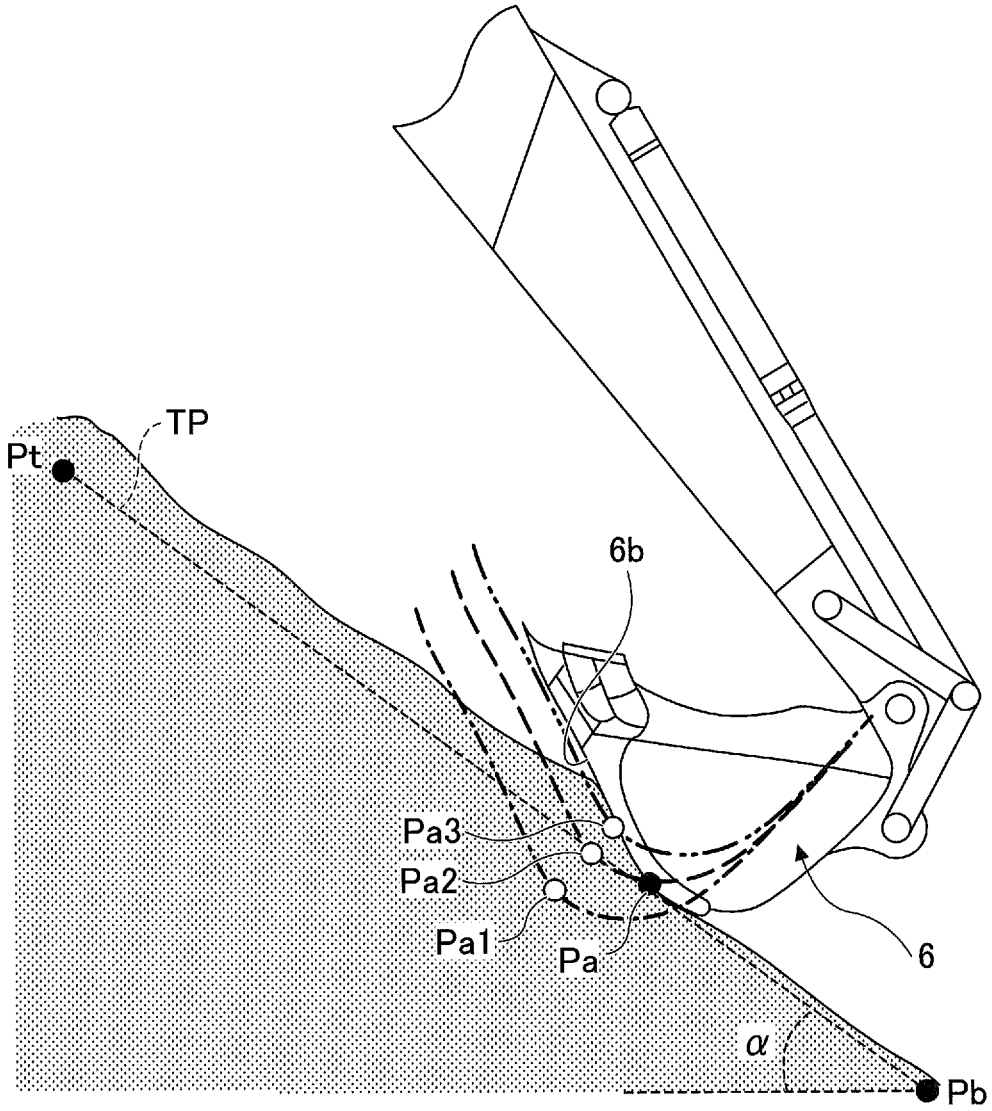
FIG. 9 is a diagram illustrating the movement of the bucket during the slope finishing work.

According to the above-described control to maintain the pressing force at the predetermined value F1, the predetermined point Pa on the back surface 6*b* of the bucket 6 moves in a part deeper than the intended work surface TP when the slope is soft and moves in a part shallower than the intended work surface TP when the slope is hard. FIG. 9 is a diagram illustrating the movement of the bucket 6 during the slope finishing work and corresponds to FIG. 7. The attachment drawn with a solid line in FIG. 9 represents the current posture of the attachment. The dashed line in FIG. 9 represents the back surface 6*b* of the bucket 6 after passage of a predetermined time when the slope finishing assist control is performed on a slope of normal hardness. The "slope of normal hardness" means a slope of such hardness as to allow the automatic control part 54 to move the predetermined point Pa along the intended work surface TP when the slope finishing assist control to press the back surface 6*b* of the bucket 6 against the slope with a pressing force of the predetermined value F1 is executed. The one-dot chain line represents the back surface 6*b* of the bucket 6 after passage of a predetermined time when the slope finishing assist control is performed on a relatively soft slope. The two-dot chain line represents the back surface 6*b* of the bucket 6 after passage of a predetermined time when the slope finishing assist control is performed on a relatively hard slope. Thus, the predetermined point Pa on the back surface 6*b* of the bucket 6 moves in a part deeper than the intended work surface TP as indicated by the one-dot chain line in the case of a soft slope and moves in a part shallower than the intended work surface TP as indicated by the two-dot chain line in the case of a hard slope.

The automatic control part 54, for example, continuously executes the above-described slope finishing assist control until the predetermined point Pa on the back surface 6*b* of the bucket 6 arrives at the position Pt corresponding to the top of the slope in the intended work surface TP or until the slope finish switch is depressed again. The automatic control part 54 may also be configured to so notify the operator through at least one of the display device 40, the audio output device 43, etc., when the predetermined point Pa arrives at the position Pt.

Figure 10:
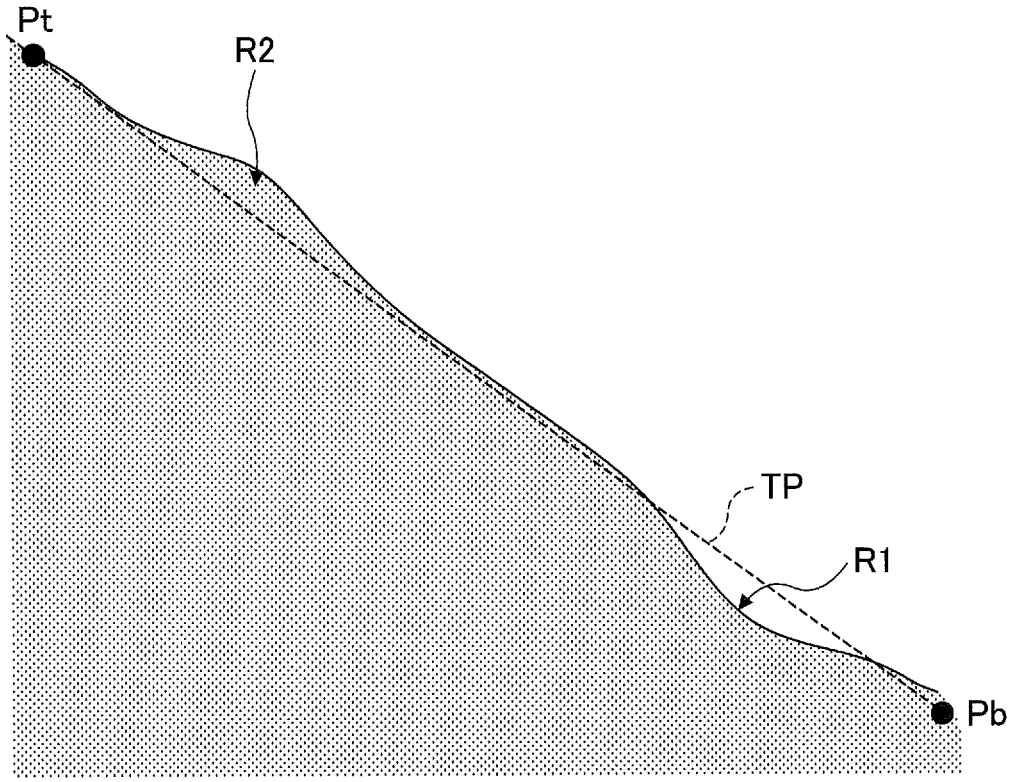
FIG. 10 is a diagram illustrating a slope formed by slope finishing assist control.

FIG. 10 is a sectional view of a slope formed by the slope finishing assist control and corresponds to FIGS. 7 and 9. As illustrated in FIG. 10, the machine guidance part 50 can form a depression R1 that is a part deeper than the intended work surface TP in a relatively soft portion and can form a protuberance R2 that is a part shallower than the intended work surface TP in a relatively hard portion of the roughly finished slope.

When the depth of the depression R1 relative to the intended work surface TP exceeds a predetermined depth, the machine guidance part 50 may output an alarm. For example, the machine guidance part 50 may display a text message to the effect that the slope is soft on the display device 40 or may output a voice message to that effect from the audio output device 43. In this case, the machine guidance part 50 may stop the movement of the attachment. The same is true for the case where the height of the protuberance R2 relative to the intended work surface TP exceeds a predetermined height.

Specifically, for example, after moving the bucket 6 from the toe to the top of a slope during a single stroke of surface finishing work, the machine guidance part 50 derives a distribution of height differences (vertical distances) between the slope formed by the single stroke of slope finishing work and the intended work surface TP. The distribution of height differences is represented by, for example, vertical distances at respective points arranged at predetermined intervals on a line segment connecting the toe and the top of the slope. For example, the machine guidance part 50 derives the vertical distances at respective points based on the trajectory of the predetermined point Pa on the back surface 6*b* of the bucket 6 during execution of the single stroke of slope finishing work. Alternatively, the machine guidance part 50 may derive the vertical distances at respective points based on the output of an ultrasonic sensor, a millimeter wave radar, a monocular camera, a stereo camera, a LIDAR, a distance image sensor, an infrared sensor or the like, after execution of the single stroke of slope finishing work.

The machine guidance part 50 compares each of the vertical distances at the points with a reference distance. The reference distance may be a value recorded in advance or may be a value set work site by work site, for example.

For example, when all of the vertical distances are less than or equal to a reference distance X (typically, several tens of millimeters), that is, when the respective heights of the points in the formed slope are within the range of ±X from the intended work surface TP, the machine guidance part 50 determines that the slope has been formed according to the intended work surface TP. When the vertical distance exceeds the reference distance at at least one of the points, the machine guidance part 50 determines that the slope is not formed according to the intended work surface TP. At this point, the machine guidance part 50 identifies which position (coordinates) in an absolute coordinate system or a relative coordinate system is not formed according to the intended work surface TP. The machine guidance part 50 can lead the operator to backfill work or scraping work through screen display, control the attachment, etc., based on information on the position (coordinates).

In response to determining that the slope is not formed according to the intended work surface TP, the machine guidance part 50 may output an alarm.

The machine guidance part 50 may be configured to be able to display information on the depression R1 and the protuberance R2 on the display device 40. For example, the machine guidance part 50 records the trajectory of the predetermined point Pa on the back surface 6*b* of the bucket 6 during execution of the slope finishing assist control as information on the current shape of the slope formed by the slope finishing assist control. The machine guidance part 50 compares information on the intended work surface TP and the information on the current shape of the slope to identify the area of the depression R1 that is a part deeper than the intended work surface TP. The machine guidance part 50 displays an image regarding the area of the depression R1 over an image regarding the slope displayed on the display device 40. The same is true for the protuberance R2 that is a part shallower than the intended work surface TP.

Figure 11:
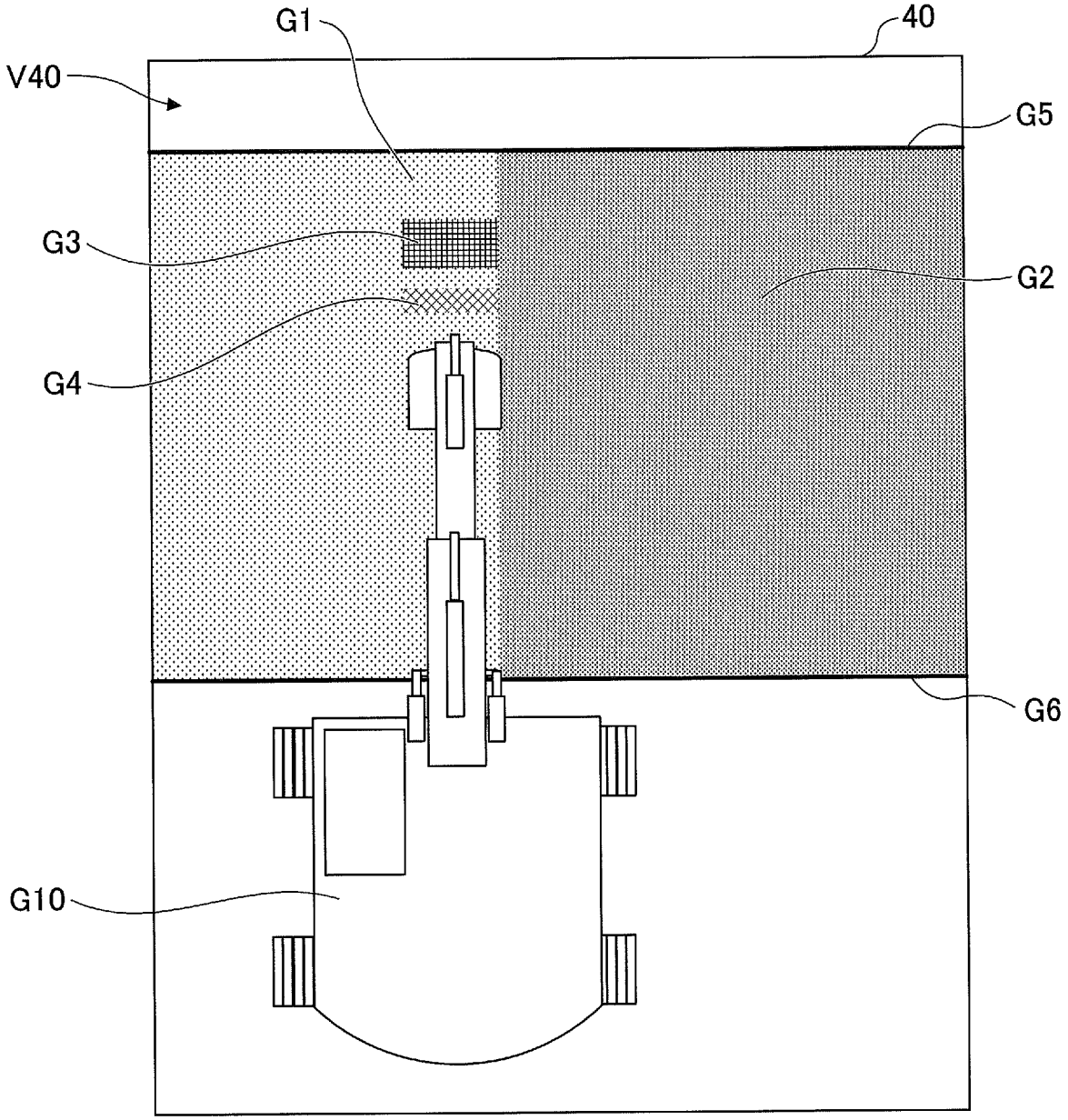
FIG. 11 is a display example of a work assistance screen.

FIG. 11 illustrates a display example of a work assistance screen V40 including an image regarding a slope in a work area. The work assistance screen V40 includes a graphic shape that represents the state of a slope as viewed from directly above, the slope descending as viewed from the shovel 100. Part of the graphic shape may be an image captured by the image capturing device S6.

According to the example of FIG. 11, the work assistance screen V40 includes an image G1 that represents the finished state of slope finishing (final finishing), an image G2 that represents the finished state of rough finishing, an image G3 that represents the depression R1, an image G4 that represents the protuberance R2, an image G5 that represents the toe of a slope, an image G6 that represents the top of the slope, and an image G10 that represents the shovel 100.

The image G1 represents a slope finished with final finishing, that is, an area of the slope formed by the slope finishing assist control. The image G2 represents a slope finished with rough finishing, that is, an area of the slope to be subjected to final finishing. The image G10 may be displayed in such a manner as to change according to the actual movement of the shovel 100. The image G10 may be omitted.

The operator of the shovel 100 can intuitively understand the positions and areas of the depression R1 and the protuberance R2 by looking at the work assistance screen V40. Therefore, the operator can, for example, form and reinforce a slope by filling the depression R1 with soil and performing compaction. Furthermore, the operator can form a slope by scraping off the protuberance R2 through excavation using the teeth tips of the bucket 6.

The operator of the shovel 100 may use the slope finishing assist control when performing slope finishing again on a formed portion filled with soil and subjected to compaction. For example, the operator depresses the slope finish switch with the predetermined point Pa on the back surface 6b of the bucket 6 coinciding with the intended work surface TP at the position closest to the toe of the slope in the formed portion. The automatic control part 54 may automatically move the attachment so that the predetermined point Pa coincides with the intended work surface TP at the position closest to the toe of the slope in the formed portion. In this case, the automatic control part 54 may correct an area to be subjected to the slope finishing assist control. For example, the automatic control part 54 may end the execution of the slope finishing assist control of this time when the predetermined point Pa arrives at not the position Pt corresponding to the top of the slope but the position closest to the top of the slope in the formed portion. This is because a portion other than the formed portion of the slope already subjected to slope finishing work does not require second pressing.

The automatic control part 54 may also be configured to so notify the operator through at least one of the display device 40, the audio output device 43, etc., when the predetermined point Pa arrives at the upper end of the formed portion.

While including a graphic shape that represents the state of the slope as viewed from directly above according to the example of FIG. 11, the work assistance screen V40 may also be configured to include a graphic shape that represents a vertical cross section of the slope. Furthermore, the work assistance screen V40 may also be configured to include an image that represents the shaped state of the depression R1 such that the image is distinguishable from the image G3 representing the depression R1. Likewise, the work assistance screen V40 may also be configured to include an image that represents the shaped state of the protuberance R2 such that the image is distinguishable from the image G4 representing the protuberance R2.

Furthermore, the machine guidance part 50 may also be configured to calculate the amount of soil necessary to fill in the depression R1 (hereinafter, "the amount of additional soil"). For example, the machine guidance part 50 may be configured to, after a slope is formed by the execution of the slope finishing assist control, calculate the volume of the depression R1 by comparing information on the intended work surface TP and the information on the current shape of the slope, and calculate the amount of additional soil based on the volume. In this case, the machine guidance part 50 may display information on the amount of additional soil in the work assistance screen V40. By looking at the work assistance screen V40, the operator of the shovel 100 can intuitively understand the position and area of the depression R1 and easily understand how much additional soil can fill in the depression R1.

The machine guidance part 50 may store information on shaping, etc., so that a work manager or the like can understand the details of unplanned work such as the work of filling in the depression R1 and the work of scraping the protuberance R2. The shaping-related information includes at least one of, for example, an area subjected to shaping, time required for shaping, the amount of soil used to fill in the depression R1, etc. This configuration enables the work manager or the like to not only manage the finished portion of a work target such as a slope but also perform detailed site management, perform detailed progress management, and make appropriate corrections in a work process.

Figure 12:
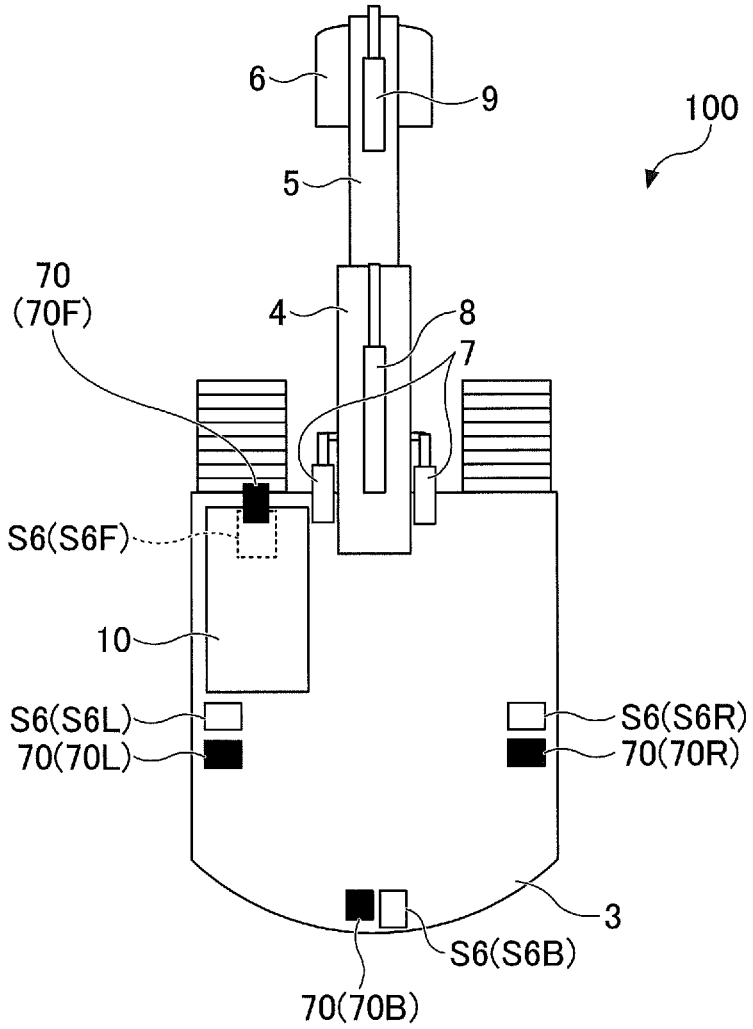
FIG. 12 is a plan view of the shovel including a space recognition device.

The machine guidance part 50 may also be configured to be able to obtain information on each of the depression R1 and the protuberance R2 based on the output of a space recognition device 70 as illustrated in FIG. 12. FIG. 12 is a plan view of the shovel including the space recognition device 70.

The space recognition device 70 is configured to be able to detect an object present in a three-dimensional space around the shovel 100. Specifically, the space recognition device 70 is configured to be able to calculate the distance between the space recognition device 70 or the shovel 100 and an object recognized by the space recognition device 70. Examples of the space recognition device 70 include an ultrasonic sensor, a millimeter wave radar, a monocular camera, a stereo camera, a LIDAR, a distance image sensor, and an infrared sensor. According to the example illustrated in FIG. 12, the space recognition device 70 is constituted of four LIDARs attached to the upper turning body 3. Specifically, the space recognition device 70 is constituted of a front sensor 70F attached to the front end of the upper surface of the cabin 10, a back sensor 70B attached to the back end of the upper surface of the upper turning body 3, a left sensor 70L attached to the left end of the upper surface of the upper turning body 3, and a right sensor 70R attached to the right end of the upper surface of the upper turning body 3.

The back sensor 70B is placed next to the back camera S6B, the left sensor 70L is placed next to the left camera S6L, and the right sensor 70R is placed next to the right camera S6R. The front sensor 70F is placed next to the front camera S6F across the top plate of the cabin 10. The front sensor 70F, however, may alternatively be placed next to the front camera S6F on the ceiling of the cabin 10.

The machine guidance part 50, for example, may generate the image G3 that represents the depression R1 in the work assistance screen V40 based on information on the depression R1 recognized by the front sensor 70F. The information on the depression R1 is, for example, at least one of the depth, area, etc., of the depression R1. The same is true for the image G4 that represents the protuberance R2.

For example, the machine guidance part 50 may change at least one of the color, luminance, etc., of pixels constituting the image G3 in accordance with the depth of the depression R1. Likewise, the machine guidance part 50 may change at least one of the color, luminance, etc., of pixels constituting the image G4 in accordance with the height of the protuberance R2. According to this configuration, the machine guidance part 50 can cause the operator of the shovel 100 to more easily understand information on irregularities of a slope.

Furthermore, the machine guidance part 50 may generate the image G3 that represents the depression R1 and the image G4 that represents the protuberance R2 in the work assistance screen V40 based on the trajectory of the predetermined point Pa on the back surface 6*b* of the bucket 6 during execution of the slope finishing assist control and information on slope irregularities recognized by the front sensor 70F. According to this configuration, the machine guidance part 50 can further improve the accuracy of the information on slope irregularities. In this case, the machine guidance part 50 identifies which position (coordinates) in an absolute coordinate system or a relative coordinate system is not formed according to the intended work surface TP. The machine guidance part 50 can lead the operator to backfill work or scraping work through screen display, control the attachment, etc., based on information on the position (coordinates). That is, because the positions of the depression R1 and the protuberance R2 are recognized, the depression R1 and the protuberance R2 may be set as target positions. This enables the machine guidance part 50 to perform bucket position control using the depression R1 or the protuberance R2 as a target position, so that the bucket 6 automatically arrives at the target position.

As described above, the shovel 100 according to an embodiment of the present invention includes the lower traveling body 1, the upper turning body 3 turnably mounted on the lower traveling body 1, the cabin 10 mounted on the upper turning body 3 as a cab, the attachment attached to the upper turning body 3, the controller 30 serving as a control device, and the display device 40. The controller 30 is configured to move the end attachment of the attachment relative to the intended work surface TP with the ground being pressed with a predetermined force by the working part of the end attachment, in response to a predetermined operation input related to the attachment. According to the above-described embodiment, the automatic control part 54 in the machine guidance part 50 included in the controller 30 is configured to move the bucket 6 along the intended work surface TP with the ground being pressed with a predetermined pressing force by the back surface 6*b* of the bucket 6, in response to an arm closing operation on the arm operating lever 26B. Furthermore, the display device 40 is configured to display information on irregularities of the ground provided by the movement of the bucket 6 along the intended work surface TP.

According to this configuration, the shovel 100 can assist in forming a more uniform finished surface. This is because the shovel 100 can, for example, notify the operator of the position and area of the depression R1 in a slope formed by the slope finishing assist control in an intuitive manner. Furthermore, this is because the operator who has understood the position and area of the depression R1 can form the slope by filling the depression R1 with soil and performing compaction.

Furthermore, because the shovel 100 can form a slope while maintaining an appropriate pressing force, it is possible to prevent a jack-up from being caused by an excessive pressing force. Therefore, the shovel 100 can prevent work from being interrupted by a shift in the position of the shovel 100 or the like and can improve work efficiency. Furthermore, the shovel 100 can prevent formation of a soft finished surface.

An embodiment of the present invention is described in detail above. The present invention, however, is not limited to the above-described embodiment. Various variations, replacements, etc., may be applied to the above-described embodiment without departing from the scope of the present invention. Furthermore, the separately described features may be suitably combined as long as causing no technical contradiction.

For example, according to the above-described embodiment, the controller 30 is configured to move the end attachment of the attachment along the intended work surface TP with the ground being pressed with a predetermined force by the working part of the end attachment, in response to a predetermined operation input related to the attachment. Specifically, the automatic control part 54 in the machine guidance part 50 included in the controller 30 is configured to move the bucket 6 along the intended work surface TP with the ground being pressed with a predetermined pressing force by the back surface 6*b* of the bucket 6, in response to an arm closing operation on the arm operating lever 26B. The present invention, however, is not limited to this configuration. For example, the automatic control part 54 may be configured to assist in slope tamping work.

Specifically, the automatic control part 54 may be configured to bring the bucket 6 into vertical contact with the intended work surface TP in response to a boom lowering operation on the boom operating lever 26A.

More specifically, the operator of the shovel 100 moves the bucket 6 to a desired position over a slope, and operates the boom operating lever 26A in the boom lowering direction while pressing a predetermined switch.

At this point, the automatic control part 54 automatically extends or retracts at least one of the arm cylinder 8 and the bucket cylinder 9 as the boom cylinder 7 retracts, so that the back surface 6*b* of the bucket 6 is parallel to the intended work surface TP. This is for causing an inclined surface contacted by the back surface 6*b* of the bucket 6 to parallel the intended work surface TP.

Then, while monitoring the boom rod pressure and the boom bottom pressure, the automatic control part 54 automatically extends or retracts at least one of the arm cylinder 8 and the bucket cylinder 9 as the boom cylinder 7 retracts so that the boom differential pressure becomes a target differential pressure. The target differential pressure is so set as to change according as the posture of the excavation attachment changes, so that the back surface 6*b* of the bucket 6 can press the slope with a uniform force irrespective of a difference in the posture of the excavation attachment, the same as in the case of the slope finishing assist control.

When the boom differential pressure reaches a predetermined target differential pressure, the automatic control part 54 stops such a movement of the attachment as to press the back surface 6*b* of the bucket 6 into the inclined surface, irrespective of the operator's boom lowering operation.

Thus, by executing feedback control of the boom differential pressure, the automatic control part 54 causes the ground to be pressed with a predetermined pressing force by the back surface 6*b* of the bucket 6. The automatic control part 54 may also cause the ground to be pressed with a predetermined pressing force by the back surface 6*b* of the bucket 6 by executing feedback control of other physical quantities than the boom differential pressure. Furthermore, the automatic control part 54 may also cause the ground to be pressed with a predetermined pressing force by the back surface 6*b* of the bucket 6 by executing feedback control of the pressing force based on the output of a sensor that detects the pressing force.

Thereafter, the operator of the shovel 100 operates the boom operating lever 26A in the boom raising operation to raise the bucket 6 into the air and move the bucket 6 to a desired position over the slope.

By repeatedly performing the above-described operation, the operator of the shovel 100 can compact the entire area of the slope by slope tamping.

The information communicating part 53 may be configured to identify the positions and areas of irregularities of the formed slope from the posture of the excavation attachment at the time when the boom differential pressure reaches a predetermined target differential pressure and display an image related to the slope irregularities on the display device 40.

Furthermore, while executed in forming a descending slope as viewed from the shovel 100 according to the above-described embodiment, the slope finishing assist control may also be executed in forming an ascending slope as viewed from the shovel 100. Furthermore, the slope finishing assist control may also be executed in forming a horizontal finished surface.

Furthermore, according to the above-described embodiment, the machine guidance part 50 is configured to display information on irregularities of the ground on the display device 40 in association with construction drawing information such as the intended work surface TP, the position Pt corresponding to the top of the slope, the image G6 representing the top of the slope, the slope top distance L, the position Pb corresponding to the toe of the slope, and the image G5 representing the toe of the slope. Here, the construction drawing information may include information on a fixed ruler and two-dimensional or three-' dimensional construction drawing data.

Figure 13:
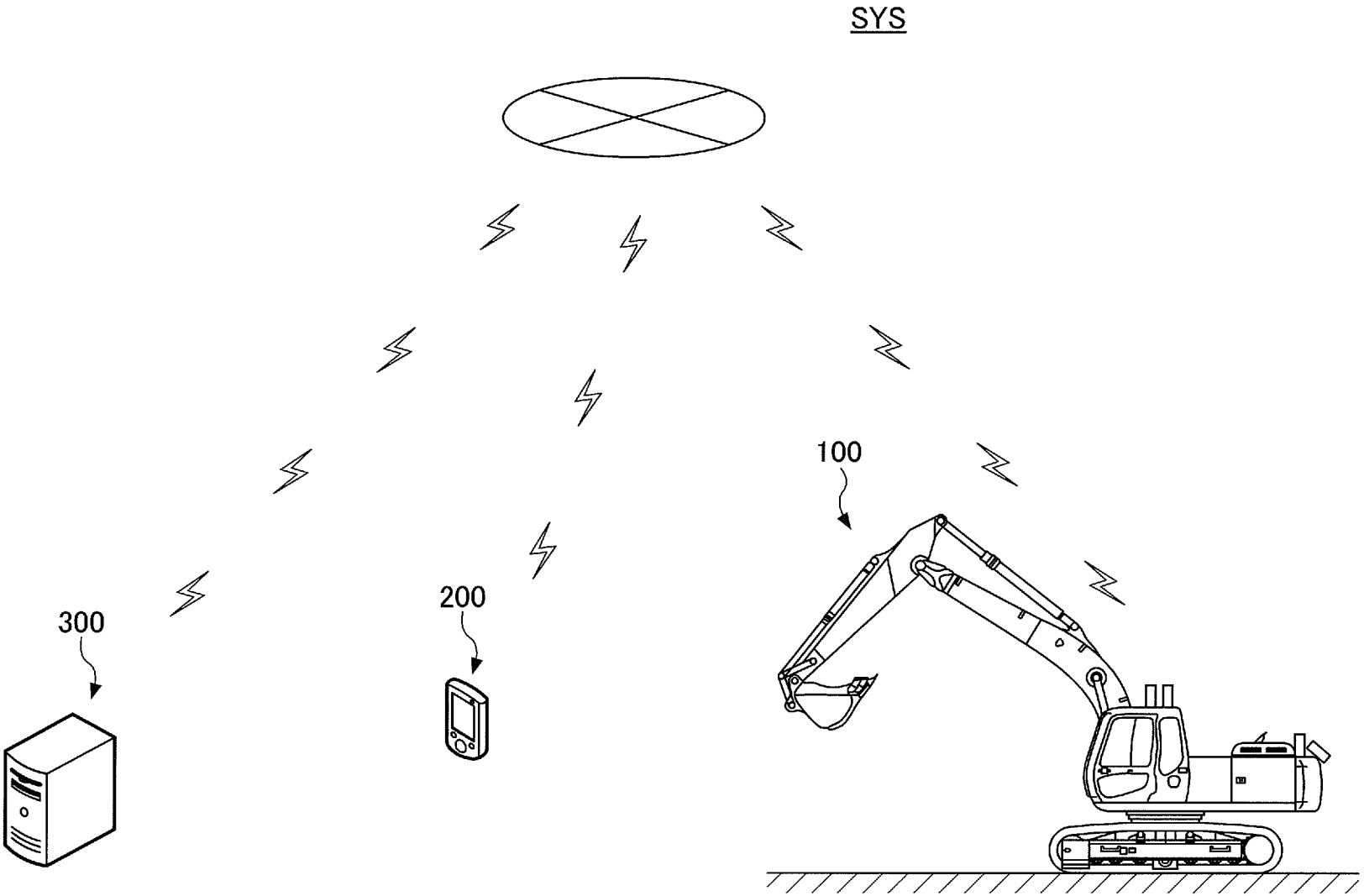
FIG. 13 is a schematic diagram illustrating an example configuration of a shovel management system.

Furthermore, the shovel 100 may be a constituent of a shovel management system SYS as illustrated in FIG. 13. FIG. 13 is a schematic diagram illustrating an example configuration of the shovel management system SYS. The management system SYS is a system that manages the shovel 100. According to this embodiment, the management system SYS is constituted mainly of the shovel 100, an assist device 200, and a management apparatus 300. Each of the shovel 100, the assist device 200, and the management apparatus 300 constituting the management system SYS may be one or more in number. According to this embodiment, the management system SYS includes the single shovel 100, the single assist device 200, and the single management apparatus 300.

The assist device 200 is a portable terminal device, and is, for example, a computer such as a notebook PC, a tablet PC, or a smartphone carried by a worker or the like at a work site. The assist device 200 may also be a computer carried by the operator of the shovel 100.

The management apparatus 300 is a stationary terminal device, and is, for example, a server computer installed in a management center or the like outside a work site. The management apparatus 300 may also be a portable computer (for example, a portable terminal device such as a notebook PC, a tablet PC, or a smartphone).

The work assistance screen V40 may be displayed on the display device of the assist device 200 and may be displayed on the display device of the management apparatus 300.

What is claimed is:

1. A shovel comprising:

a lower traveling body;

an upper turning body turnably mounted on the lower traveling body;

a cab mounted on the upper turning body;

an attachment attached to the upper turning body;

a hardware processor configured to move an end attachment of the attachment relative to an intended work surface with a ground being pressed with a predetermined force by a working part of the end attachment, in response to a predetermined operation input related to the attachment, and to record an area of the ground subjected to work by said moving the end attachment; and a display device configured to display information on progress of the work and information on an irregularity of the ground based on the recorded area of the ground subjected to the work by said moving the end attachment.

2. The shovel as claimed in claim 1, wherein the hardware processor is configured to derive the information on the irregularity of the ground from a change in a posture of the attachment during of said moving the end attachment relative to the intended work surface.

3. The shovel as claimed in claim 1, wherein the hardware processor is configured to calculate an amount of soil to fill in a depression of the ground.

4. The shovel as claimed in claim 1, wherein the display device is configured to display the information on the irregularity of the ground in association with construction drawing information.

5. The shovel as claimed in claim 1, wherein the hardware processor is configured to execute feedback control of a pressing force or feedback control of a boom differential pressure that is a pressure difference between a boom rod pressure and a boom bottom pressure.

6. The shovel as claimed in claim 1, wherein the predetermined force is a force at a time when a boom differential pressure reaches a target differential pressure, the boom differential pressure being a pressure difference between a boom rod pressure and a boom bottom pressure, and the target differential pressure changes according as a posture of the attachment changes.

7. The shovel as claimed in claim 1, wherein the predetermined force is a force at a time when an arm differential pressure reaches a target differential pressure, the arm differential pressure being a pressure difference between an arm rod pressure and an arm bottom pressure, and the target differential pressure changes according as a posture of the attachment changes.

8. The shovel as claimed in claim 1, wherein the information on the irregularity of the ground is information on a surface of the ground formed when the ground is pressed by the predetermined force by the working part.

9. The shovel as claimed in claim 1, wherein the display device configured to display an image regarding the irregularity of the ground over an image regarding the progress of the work.

10. The shovel as claimed in claim 1, wherein the display device configured to display the information on the progress of the work, the information on the irregularity of the ground, and an image representing the shovel including the attachment on a same screen.

11. A shovel comprising:

a lower traveling body;

an upper turning body turnably mounted on the lower traveling body;

an attachment attached to the upper turning body; and a hardware processor configured to move an end attachment of the attachment relative to an intended work surface with a ground being pressed with a predetermined force by a working part of the end attachment, in response to a predetermined operation input related to the attachment, and to output an alarm in response to determining that the ground is not formed according to the intended work surface.

12. The shovel as claimed in claim 11, wherein the hardware processor is configured to obtain information on an irregularity of the ground.

13. The shovel as claimed in claim 11, wherein the hardware processor is configured to control a position or speed of the working part in a same direction as the intended work surface.

14. The shovel as claimed in claim 11, wherein the hardware processor is configured to press the working part with the predetermined force in a direction perpendicular to the intended work surface.

15. The shovel as claimed in claim 11, wherein the hardware processor is configured to move a bucket relative to the intended work surface with the ground being pressed with the predetermined force by a back surface of the bucket.

16. The shovel as claimed in claim 11, wherein the hardware processor is configured to move a bucket relative to the intended work surface with the ground being pressed with the predetermined force by a back surface of the bucket and a predetermined angle being maintained between the back surface of the bucket and the intended work surface.

17. The shovel as claimed in claim 11, wherein the hardware processor is configured to move the end attachment relative to the intended work surface while keeping the ground pressed with the predetermined force by the working part, in response to the predetermined operation input related to the attachment.

* * * * *